US011346631B1

(12) United States Patent
Kopman et al.

(10) Patent No.: US 11,346,631 B1
(45) **Date of Patent: *May 31, 2022**

(54) QUICK START PROJECTILE LAUNCHER AND METHODS

(71) Applicant: Hasbro, Inc., Pawtucket, RI (US)

(72) Inventors: Vladislav Kopman, New York, NY (US); Christopher David Miller, Tarrytown, NY (US); Robert James Victor, New York, NY (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/129,052

(22) Filed: Dec. 21, 2020

Related U.S. Application Data

(63) Continuation of application No. 16/729,365, filed on Dec. 28, 2019, now Pat. No. 10,876,809.

(60) Provisional application No. 62/851,855, filed on May 23, 2019, provisional application No. 62/786,233, filed on Dec. 28, 2018.

(51) Int. Cl.
*F41B 4/00* (2006.01)

(52) U.S. Cl.
CPC ..... *F41B 4/00* (2013.01)

(58) Field of Classification Search
CPC ..... A63B 69/406; F41B 4/00
See application file for complete search history.

(56) References Cited

U.S. PATENT DOCUMENTS

| | | | |
|---|---|---|---|
| 1,441,975 | A | 1/1923 | Edelin |
| 1,488,995 | A | 4/1924 | McCollom |
| 2,715,299 | A | 8/1955 | Steitz |
| 2,737,942 | A | 3/1956 | Horowitz et al. |
| 3,054,536 | A | 9/1962 | Sagarin |
| 3,420,133 | A | 1/1969 | Proll |
| 3,990,426 | A | 11/1976 | Stokes |
| 4,170,215 | A | 10/1979 | Kettlestrings |
| 4,248,202 | A | 2/1981 | Jaworski et al. |
| 4,659,320 | A | 4/1987 | Rich et al. |
| 4,723,532 | A | 2/1988 | Osojnak |
| 4,841,945 | A | 6/1989 | Braden |
| 4,890,404 | A | 1/1990 | Ferri |
| 5,471,967 | A | 12/1995 | Matsuzaki et al. |
| 5,529,050 | A | 6/1996 | D'Andrade |
| 6,488,019 | B2 | 12/2002 | Kotsiopoulos |
| 6,523,535 | B2 | 2/2003 | Rehkemper et al. |
| 7,011,084 | B2 | 3/2006 | Richard |
| 7,051,727 | B2 | 5/2006 | Wu |
| 8,082,909 | B2 | 12/2011 | Sopinsky et al. |
| 8,127,753 | B1 | 3/2012 | Brooks et al. |

(Continued)

*Primary Examiner* — John A Ricci
(74) *Attorney, Agent, or Firm* — Perry Hoffman

(57) ABSTRACT

A toy launch apparatus which includes single motor synchronized quick start/advanced start flywheel apparatus employing a drive mechanism for advancing rotation of projectile-propelling flywheels and driving a projectile-feeding advance mechanism for automatic and sequenced projectile-launching operation, with movement of the pusher mechanism to rapidly fire darts from the toy apparatus. The system apparatus and methods employing the single-motor-driven mechanism facilitate advanced starting projectile-propelling flywheels and driving a projectile-feeding mechanism in a novel fashion for automatic and sequenced projectile-launching operation with reduced mechanism mass and cost.

20 Claims, 16 Drawing Sheets

(56) References Cited

U.S. PATENT DOCUMENTS

| | | | | |
|---|---|---|---|---|
| 8,353,277 | B2 | 1/2013 | Huebl | |
| 8,397,705 | B2 | 3/2013 | DeHaan et al. | |
| 8,567,378 | B2 | 10/2013 | Nugent | |
| 8,695,579 | B2 | 4/2014 | Huebl | |
| 8,833,355 | B2 | 9/2014 | Paulson | |
| 8,875,688 | B2 | 11/2014 | Nugent | |
| 8,967,130 | B2 | 3/2015 | Victor et al. | |
| 9,027,541 | B2 | 5/2015 | Huebl | |
| 9,194,646 | B2 | 11/2015 | Victor et al. | |
| 9,389,042 | B1 | 7/2016 | Clayton | |
| 9,958,230 | B1 | 5/2018 | Nugent et al. | |
| 10,876,809 | B1 * | 12/2020 | Kopman | F41B 4/00 |
| 2002/0166551 | A1 | 11/2002 | Lee | |
| 2009/0095272 | A1 | 4/2009 | Zimmerman | |
| 2010/0206281 | A1 | 8/2010 | Kanitz et al. | |
| 2013/0112184 | A1 | 5/2013 | Corsiglia et al. | |
| 2013/0312722 | A1 | 11/2013 | Price | |

* cited by examiner

QUICK START PROJECTILE LAUNCHER AND METHODS

FIELD OF THE INVENTION

The present invention relates to toy projectile launchers and more particularly, to apparatus and methods employing a single-motor-driven mechanism for quick start/advanced starting projectile-propelling flywheels and driving a projectile-feeding mechanism in a novel fashion for automatic and sequenced projectile-launching operation with reduced mechanism mass and cost.

BACKGROUND OF THE INVENTION

Projectile launchers/shooting mechanisms are well known in the art and include mechanisms for launching toy darts, balls of various sizes, paint balls, etc., and even paper money. Various toy launchers/guns known in the art employ a projectile shooting mechanism made up of two opposed rotatable wheels (known as a drive or fly wheels) which engage a dart or other various balls and projectiles there between. One or two motors drive rotation of one or both wheels creating a launching force frictionally applied to the dart/projectile as the dart/projectile engages a wheel surface on each of the opposed rotatable wheels for launching from the launcher mechanism. However, none of the known projectile launchers employs a single motor (or two motor system) to automatically sequence the quick start/advanced starting of a flywheel mechanism rotating two opposed flywheels and in sequence activating a back and forth motion of a projectile feeding mechanism to advance projectiles one by one in the flywheels only when rotating at operational speed, as in the present described inventions.

Additionally, toy projectile launching devices incorporating various mechanisms are known and disclosed in several existing patents. However while propelling spring and motor launch mechanisms may be employed as separate individual mechanisms in the art, a combined mechanism providing a torsion or linear booster spring for energy storage and for priming to assist motor driven projectile propelling flywheels, as in an embodiment of the present described invention, is not known in the art to assist the single electric motor and reduce operation time, ramping up speed and sounds of the motor. Applicants' Assignees' U.S. Pat. No. 9,958,230 to Nugent, et al. for "Rapid Fire Toy Launch Apparatus" issued May 1, 2018, contents of which are incorporated by reference, discloses a motor driven continuous belt acting as a pusher to advance darts released from a magazine, then into a separate motor driven flywheel launching mechanism propelling projectiles. Applicants' Assignees' U.S. Pat. Nos. 8,967,130 and 9,194,646 to Victor, et al. for "Toy Projectile Launcher Apparatus" issued Mar. 3, 2015, contents of which are also incorporated by reference, incorporate two separate non-motorized mechanisms launching propelling projectiles, with springs including a launch arm torsion spring and a cocking slide spring with tension with the user pulling its carriage cocking slide, and with the launch arm captured by the catch structure, the cocking slide activates the carriage and the loaded projectile to a predetermined launch position and the launch arm rapidly rotated by the torsion spring impacts the loaded projectile.

U.S. Patent Application No. US2002/0166551 A1 to Lee for "Toy projectile launcher" published Nov. 14, 2002 discloses its first rotatable member as driven into rotation with an electric motor rotational power source as disclosed, while in an alternative embodiment the first rotatable member is described as separately driven by a loaded spring or other suitable driving means rather than the electric motor. A toy projectile launching device including a bullet conveying mechanism consisting of a bullet pusher connected via a lever transmission link and controlled by a trigger lever switch. A first rotatable member is driven into rotation by connecting to a rotational power source disclosed as an electric motor and purportedly in an alternative embodiment the first rotatable member being separately driven by a loaded spring or other suitable driving means rather than the electric motor. A second rotatable member is disclosed preferably as a freely rotating wheel so that an engaged projectile can be transported across the projectile shooting pass smoothly, and alternatively the free rotating wheel may be replaced with a very smooth and fixed surface with minimum adverse friction due to the second rotatable member. As disclosed, the Lee electric motor is connected to a micro-switch controlled by the trigger lever with the transmission link driven additionally for reciprocating motion as long as the micro-switch activates the electric motor.

Spring driven launchers include U.S. Pat. No. 4,170,215 for a "Disk Toy and Launcher" issued in 1979 to Kettlestrings, purports to disclose a mechanical launcher for a toy disk that has a recess for engaging and bending a leaf spring when loaded. After bending the spring, the disk is received by tabs of catch members in the launcher. When a plunger dislodges the tabs the spring propels the disk away from the launcher. U.S. Pat. No. 4,248,202 for a "Disc Launcher" issued in 1981 to Jaworski and Breslow, and purports to disclose a mechanical launcher having a circular casing, a disc magazine for feeding discs by gravity, an actuating arm movable between a loading position and a firing position, a spring and a rubber band biased trigger. In the loading position the actuating arm receives a soft round disc in front of curved edge portion. A user rotates the actuating arm and the edge portion to a firing position, the actuating arm preventing any more discs falling from the magazine, while moving a free arm of the spring loads the spring. All the while a launching slot is blocked. The user then returns the actuating arm to the loading position. When the user pulls the trigger, the free arm of the loaded spring contacts the outer peripheral portion of the disc to eccentrically propel the disc through the launching slot and away from the launcher. Another U.S. Pat. No. 4,659,320 for a "Toy Vehicle With Disc Launching Apparatus And Disks" issued in 1987 to Rich et al, discloses a toy vehicle carrying an inclined track for storing multiple disks and a spring biased catapult lever where a leaf spring lever releases to a disk peripheral edge causing the disk to spin as to is ejected.

Some known methods/mechanisms for feeding darts into a drive or fly wheel or other energized launching mechanism, include advancing mechanisms actively pushing darts or projectiles into an energized launching mechanism or, alternatively, mechanisms which remove physical barriers from a path or channel leading to a launching mechanism. Various known feeding mechanisms employ rods, pistons or hammers which actively push darts into an adjacent launching mechanism. Feeding mechanisms are known to include an elongated arm biased into contact with a stack of darts lined up adjacent a drive wheel. The arm is biased into contact with the upper most dart of the stack and urges the lower most dart into the barrel adjacent the drive wheel. A biased trigger and hammer arrangement push the dart through the barrel and into the drive wheel for firing the dart when the trigger is pulled.

None of the known feeding mechanisms however, employs a clutch and/or a swing gear linked to a trigger assembly for driving a pusher mechanism off a flywheel gear train coupled to a motor to transfer rotation of the flywheel gear train to the pusher/feeder mechanism in a novel and sequenced fashion, actuating the pusher mechanism to advance projectiles into the rotating flywheels when the trigger is pulled and the flywheels are at operating speed. Additionally, none of the know feeding mechanisms employ a continuous belt which penetrates a dart magazine to release each dart while at the same time employs one or more protrusion elements at the belt to advance each released dart in a rapid fire into the launching mechanism with priming to assist motor driven projectile propelling flywheels in a novel fashion to assist the electric motor and reduce operation time, ramping up speed and sounds of the motor launch assembly and limiting the energy generating mechanism.

Additionally, known toy launchers do not include a torsion or linear booster spring priming mechanism that stores energy for jump starting a motor driven flywheel mechanism in a novel fashion to assist an electric motor and reduce operation time, ramping up speed and sounds of the motor launch assembly. A single motor synchronized with a trigger assembly to drive priming of the torsion spring, rotation of the flywheels, and movement of the pusher mechanism to rapidly fire darts from the toy apparatus in a novel fashion by jump starting the motor driven flywheels is also not disclosed in known toy launchers.

Significantly, rather than using two separate motors for each flywheel and a third separate motor for the projectile-feeder, the present inventions disclose projectile-feeding mechanisms configured in a novel fashion to reduce mechanism mass and cost using a single motor. The inventions additionally provide for automatic and sequenced projectile-launching operations through use of a clutch structure and power-transmission element to inject a projectile or dart into a launch-channel for engagement with the projectile-feeding mechanism operating with the single-motor configuration including feeding and launching flywheel operations not disclosed in known toy launchers.

SUMMARY OF THE INVENTION

The present inventions address shortcomings of the prior art to provide a toy launch apparatus employing a single motor to automatically sequence the quick start/advanced starting of a flywheel mechanism rotating two opposed flywheels prior to activating a pusher/feeding mechanism to advance projectiles/darts into the spinning flywheels. Activating a back and forth motion of a projectile feeding mechanism to advance projectiles one by one in the flywheels occurs in sequence and only when the flywheels are rotating at operational speed.

Employing a clutch structure to drive power to the projectile-feeding mechanism provides a configuration which reduces mechanism mass and cost while providing for automatic and sequenced projectile-launching operations in a novel fashion that may be configured within toy projectile-feeding and launching apparatus, having single, or multiple, motor driven apparatus for energizing the projectile-propelling flywheels. The projectile-feeding mechanism disclosed herein operates in accord with the single-motor and flywheels through use of the clutch structure and power-transmission element sequenced to inject a projectile or dart into a launch-channel for engagement with rotating flywheels or drive wheels to launch the projectile upon the rotating flywheels being spun-up to a desired projectile-launching rotational speed.

In one embodiment of the invention, a quick start flywheel mechanism includes a motor, projectile propelling flywheels linked to the motor, and a clutch structure that engages the flywheels through a flywheel gear train. The clutch structure includes a swing gear operable between first and second positions. Also included, is a pusher mechanism disposed adjacent the flywheels and engaging the motor for advancing projectiles into the flywheels one at a time and a trigger assembly including a trigger and linkage assembly linked to the swing gear and engaging the clutch structure and the pusher mechanism, the trigger assembly jump starting rotation of the flywheels to an operating speed and activating the clutch structure when the flywheels are rotating at the operating speed, shifting the swing gear into the second position for actuating the pusher mechanism causing back and forth motion of the pusher mechanism advancing projectiles into the rotating flywheels when the trigger is pulled.

In another embodiment a single-motor powers two (2) components, flywheels and projectile-feeding mechanism off a clutch structure and a power-transmission element which may include a gear-train, or the like such as pinion gears, rather than using two separate motors for each flywheel and a third separate motor for the projectile-feeder. The gear-train is arranged and timed such that the projectile-feeding mechanisms begins injecting when or after the rotating flywheels have spun-up to desired projectile-launching rotational speed In another embodiment the clutch structure includes a centrifugal clutch which limits the projectile-feeding mechanism and is located between the flywheel-drive system and the projectile-feed mechanism. In another embodiment, the swing gear links a pusher/feeding gear train to the centrifugal-clutch includes an attached gear transmitting power to the pusher/feeding gear train through the swing gear. In another embodiment, a cam and follower interaction included between a crank gear and a pusher mechanism linkage when the swing gear mechanically engages the crank gear powered by the motor operating to sequence and activate the pusher mechanism and fly wheel propelling mechanism.

In another embodiment, a micro-switch is further included engaging the trigger and the motor for activating the motor when the trigger is depressed and shutting off power to the motor when the trigger is released. In another embodiment, the trigger linkage assembly mechanically engages the swing gear and shifts the swing gear from a first position to the second position when the trigger is pulled, and in another embodiment, the swing gear is spring biased to the first position. In another embodiment, the pusher/feeding gear train employs a scotch gear and swing gear linkage coupling the scotch gear to the swing gear allowing the swing gear to shift between first and second positions.

In another embodiment, a two-motor power system is included to drive rotation of the flywheels and the pusher/feeding system. A first motor is driving rotation with a first direct flywheel and a second motor is in driving rotation with a second flywheel, and each of the first and second motors simultaneously drive each of the first and second flywheels, respectively, as well as the pusher/feeding mechanism.

In another embodiment the clutch structure includes a booster spring engaging the motor through a spring winding gear train and engaging the flywheels through a flywheel gear train. In another embodiment, the booster spring includes a torsion booster spring engaging the motor through a spring winding gear train and engaging the flywheels through the flywheel gear train, the torsion booster spring is primed to a charged position when the motor is turned on and the trigger assembly jump starting the flywheels through the torsion booster spring. The torsion booster spring rapidly transferring stored energy from the charged torsion booster spring into the flywheels to assist the motor and jump start rotation of the flywheels before they are driven by the motor.

In another embodiment, the booster spring includes a linear spring acting through a rack and pinion gear, or an elastomeric element or the like, acting to enact a torque onto the system either directly through the flywheel mechanism or through a gearing structure such as a rack and pinion gear. In another embodiment, a grip is further included adjacent the trigger and an on/off switch coupled to the grip for energizing the motor when a user holds the grip.

In another embodiment, a toy projectile launch apparatus includes a magazine for receiving and holding projectiles, a carriage structure including a launch channel being supporting with the magazine, a feeding mechanism in communication with the magazine for injecting projectiles from the magazine into the launch channel, and a propelling mechanism coupled with the carriage structure and including flywheels in communication with the launch channel for propelling projectiles from the magazine. A feeding and launching motor and a transmission gear assembly powered with the motor to sequence and activate the feeding mechanism and the propelling mechanism is further included and a clutch is in communication transmission gear assembly to activate the feeding mechanism with the motor.

In another embodiment, the clutch is in communication transmission gear assembly powered with the motor operates to sequence and activate the feeding mechanism and the propelling mechanism, and in another embodiment, the feeding mechanism includes a spring biased cam follower from the transmission gear assembly, the spring biased cam follower which extends and retracts between a first extended and a second retracted position to engage and shuttle additional projectiles from the magazine, returning to the second retracted position to engage another projectile from the magazine. In yet another embodiment, the clutch includes a manually operable activation trigger button.

In an embodiment of the invention, a method for launching projectiles may further include steps of providing a motor, providing projectile propelling flywheels linked to the motor, providing a clutch structure engaging the flywheels, the clutch structure including a swing gear operable between a first position a second position, and providing a pusher mechanism disposed adjacent the flywheels and engaging the motor. Further steps include providing one or more projectiles at the pusher mechanism, providing a trigger assembly including a trigger and trigger linkage assembly linked to the swing gear and engaging clutch structure and the pusher mechanism, pulling the trigger turning on the motor and jump starting rotation of the flywheels, and pulling the swing gear to the second position and into engagement with the pusher mechanism. Further steps include obtaining operating speed at the flywheels and engaging the clutch structure to rotate, and transmitting power from the motor to the pusher mechanism causing back and forth motion of the pusher mechanism advancing projectiles one at a time into the rotating flywheels when the trigger is pulled.

In another embodiment the method for launching projectiles may further include a step of providing a centrifugal clutch as the clutch structure to initiate the pusher mechanism upon the flywheels obtaining a desired rotational speed for propelling projectiles. The method for launching projectiles further includes the step of providing a micro switch engaging the trigger and the motor activating the motor when the trigger is pulled and shutting off power to the motor when the trigger is released.

In another embodiment the method for launching projectiles may further include a step of providing a trigger linkage assembly mechanically engaging the swing gear to shift from a first position to a second position, and further includes the step of spring biasing the swing gear to the first position. The method for launching projectiles further includes the step of providing a scotch gear coupled to the swing gear through a swing gear linkage securing the swing gear to shift between first and second positions.

Briefly summarized, the toy launch apparatus disclosed includes single motor synchronized quick start/advanced start flywheel apparatus employing a drive mechanism for advancing rotation of projectile-propelling flywheels and driving a projectile-feeding advance mechanism for automatic and sequenced projectile-launching operation, with movement of the pusher mechanism to rapidly fire darts from the toy apparatus. The system apparatus and methods employing the single-motor-driven mechanism facilitate advanced starting projectile-propelling flywheels and driving a projectile-feeding mechanism in a novel fashion for automatic and sequenced projectile-launching operation with reduced mechanism mass and cost.

BRIEF DESCRIPTION OF THE DRAWINGS

For the purpose of facilitating an understanding of the inventions, the accompanying drawings and description illustrate preferred embodiments thereof, from which the inventions, structure, construction and operation, and many related advantages may be readily understood and appreciated.

FIG. 6A illustrates an alternative pusher/feeding mechanism including a pair of pulleys with a belt stretched therebetween and including a protrusion element for advancing darts into the flywheels, while

DETAILED DESCRIPTION OF THE EMBODIMENTS

The following description is provided to enable those skilled in the art to make and use the described embodiments set forth in the best modes contemplated for carrying out the inventions. Various modifications, however, will remain readily apparent to those skilled in the art. Any and all such modifications, equivalents, and alternatives are intended to fall within the spirit and scope of the present inventions.

The contents of Applicants' Assignees' U.S. Pat. No. 9,958,230 to Nugent, et al. for "Rapid Fire Toy Launch Apparatus" issued May 1, 2018 is hereby incorporated into the presented disclosure by reference in their entirety.

Figure 1A:
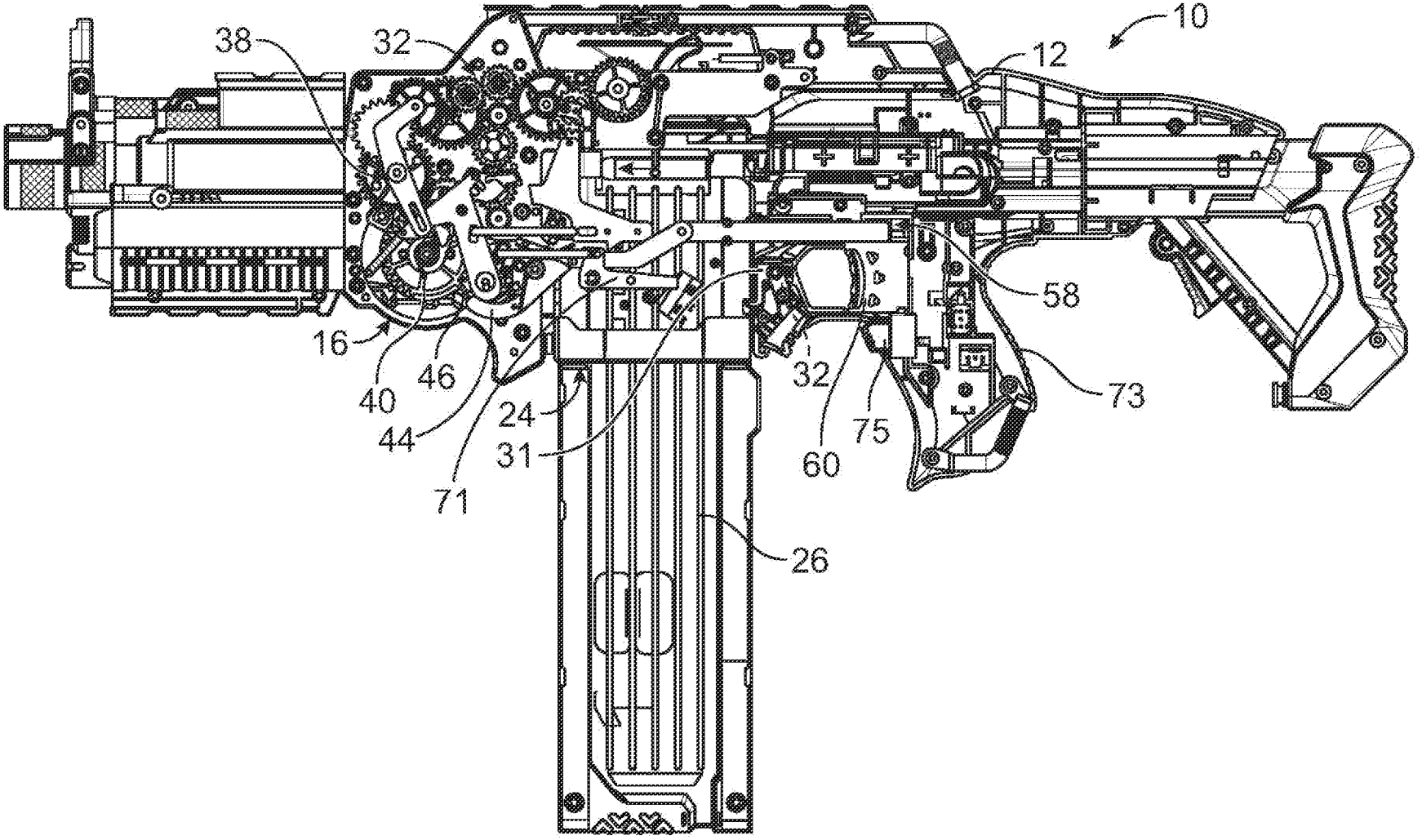
FIG. 1A is a quick start flywheel mechanism toy launch apparatus including a scope, stock, barrel, foregrip, clutch structure and dart clip of an embodiment of the present invention, with FIG. 1B viewing the back of the toy launch apparatus with parts broken away to illustrate a torsion booster spring, flywheels and pusher mechanism.
Figure 7:
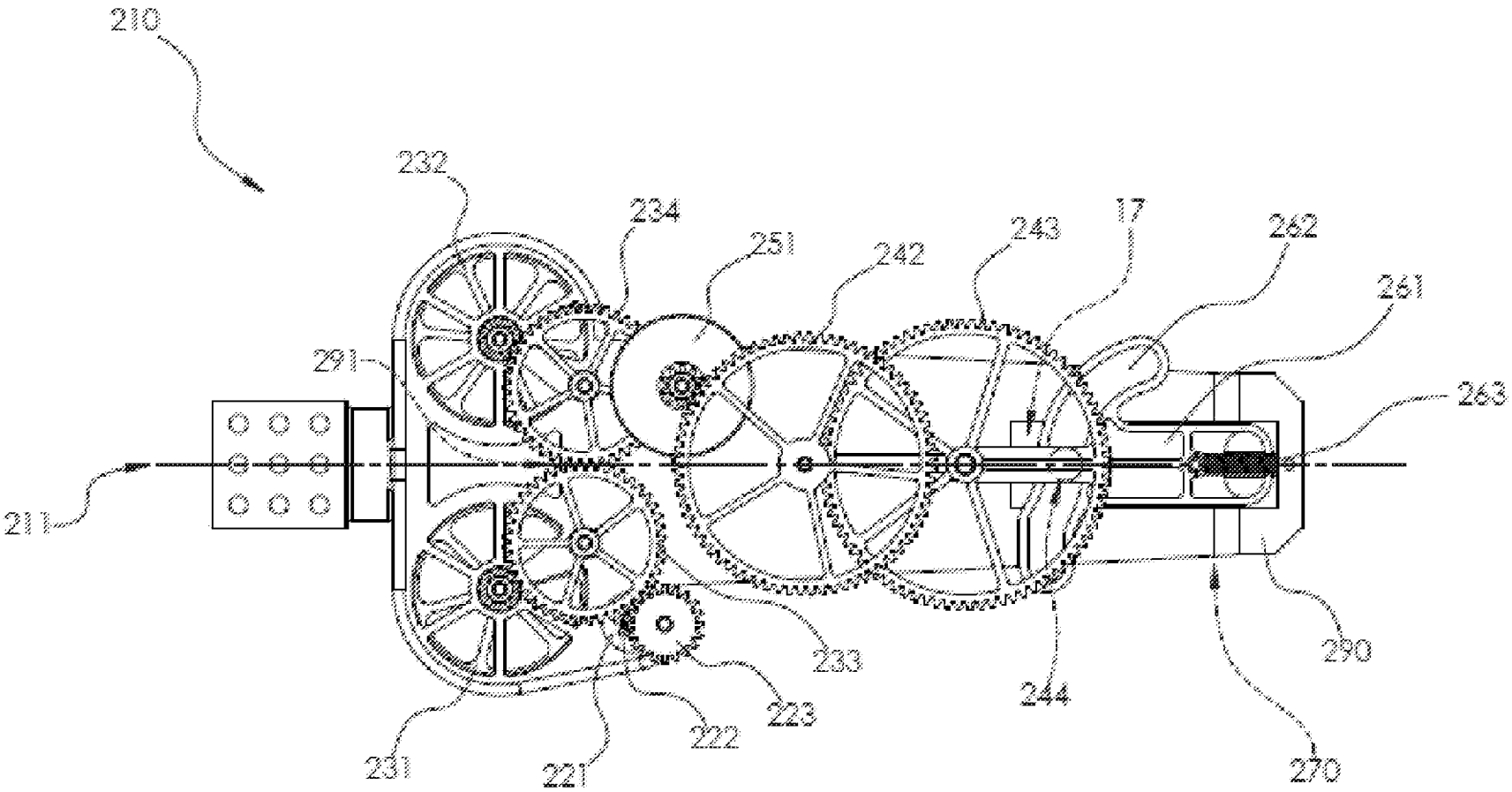
FIG. 7 is an undercarriage view of a single-motor projectile-launching apparatus in accordance with an embodiment of the present invention including a centrifugal-clutch structure engaging a projectile-feeding mechanism.
Figure 9:
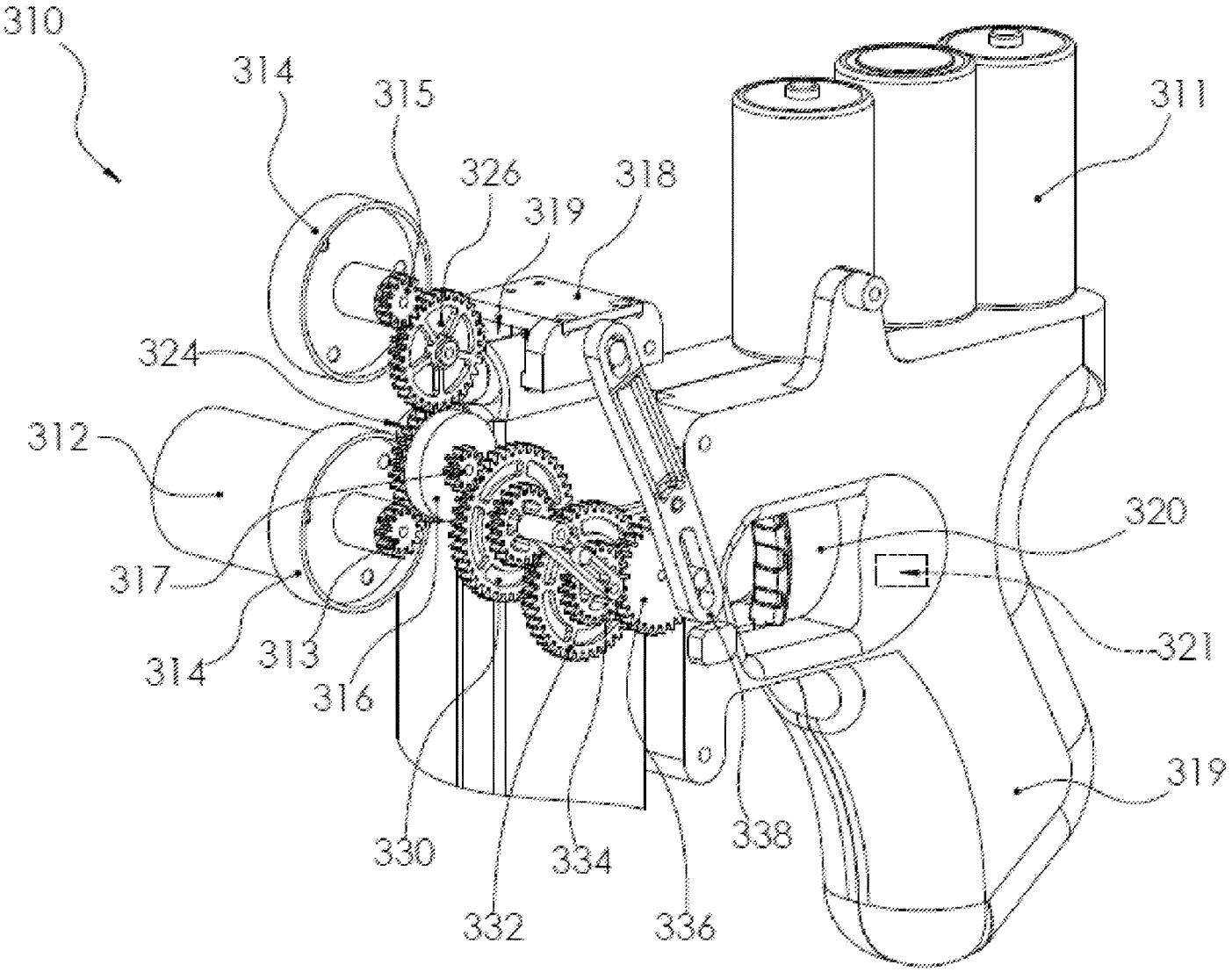
FIG. 9 is a perspective view of a single-motor projectile-launching apparatus in accordance with an embodiment of the present invention including a clutch structure engaging the flywheels and the dart pusher/feeding mechanism transmitting power to the pusher/feeding mechanism only after the flywheels are rotating at full operating speed.

A rapid-fire toy projectile launch assembly, as seen in FIGS. 1A, 7 & 9, employs a single-motor-driven mechanism for quick start/advanced starting projectile-propelling flywheels and driving a projectile pusher/feeding mechanism in a novel fashion for automatic and sequenced projectile-launching operation with reduced mechanism mass and cost. A single motor, with or without a quick start booster spring mechanism, advances rotation of the flywheel mechanism for energizing the projectile-propelling flywheels prior to activation of the projectile pusher/feeding mechanism. A motor engages the projectile propelling flywheels and a clutch structure linked to a flywheel gear train is activated to then engage the pusher/feeding mechanism disposed adjacent the flywheels and engaging the motor, through the clutch structure, for advancing projectiles into the flywheels one at a time.

A trigger assembly including a trigger and linkage assembly is in communication with the clutch structure and the pusher/feeding mechanism. The trigger assembly jump starts rotation of the flywheels to an operating through activation of the motor. At an operating speed of the flywheels, the clutch structure is activated and in turn will actuate the pusher/feeding mechanism to advance projectiles into the rotating flywheels when the trigger is pulled. The clutch structure, when activated, transmits power to a pusher/feeding gear train linked to the pusher/feeding mechanism converting the rotary motion of the gear train into a reciprocating motion of the pusher/feeding mechanism to optimize timing of projectiles being fed into the flywheels only when the flywheels are rotating at operating speed.

A rapid fire toy projectile launch assembly 10, as seen in FIG. 1A, includes a combined mechanism providing a booster spring (torsion or linear) and swing gear (clutch structure) for energy storage to jump start projectile propelling flywheels in a novel fashion by assisting an electric motor driving the flywheel mechanisms and reducing operation time for ramping up speed and sounds of the motor launch assembly and limiting the energy generating mechanism. The new combined mechanism with the torsion spring disclosed herein may also facilitate a non-powered single shot operation as well. A dart or projectile entering a launch channel engages with rotating flywheels or drive wheels to project the dart.

Figure 1B:
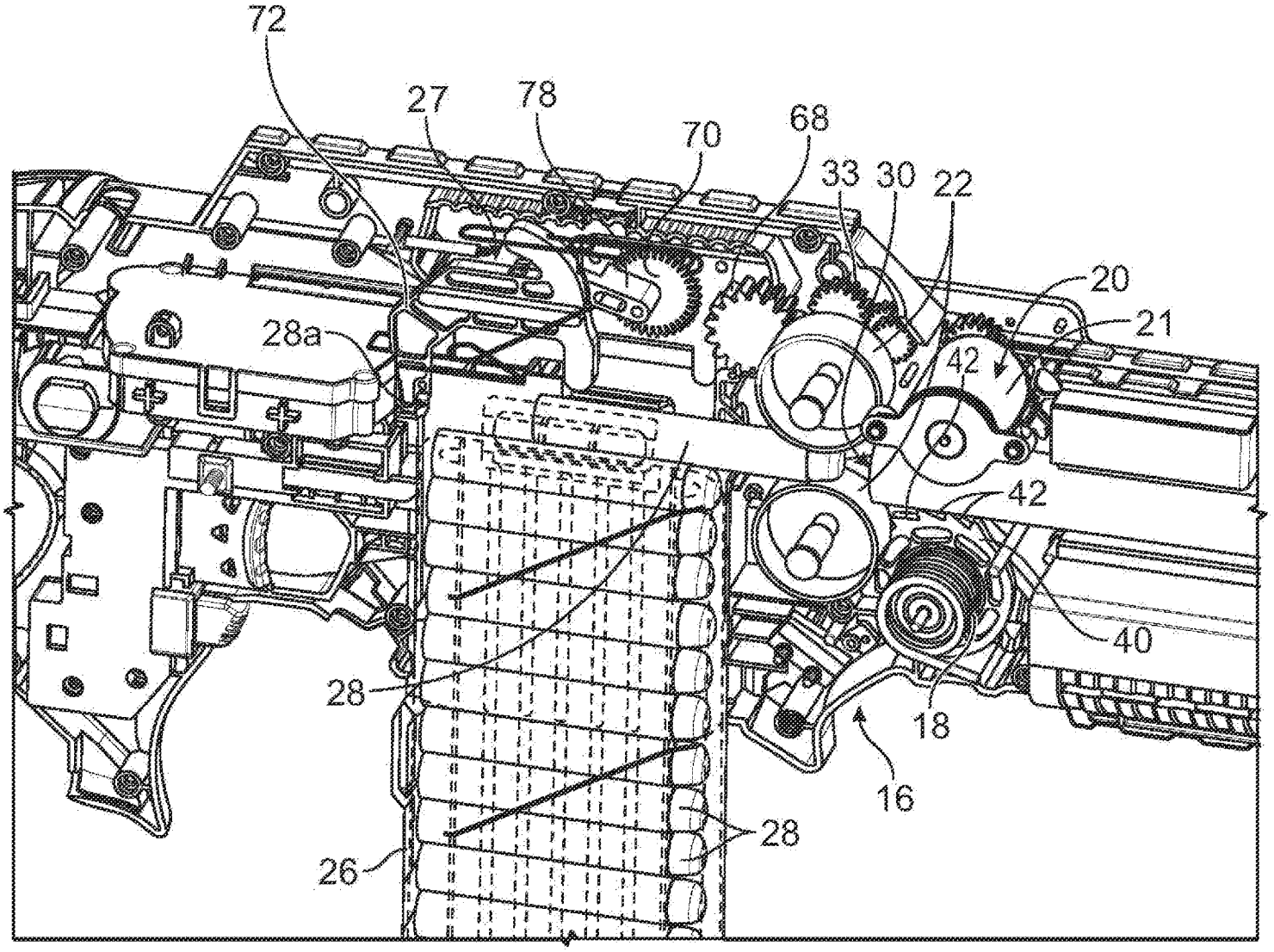

The rapid-fire toy projectile launch assembly 10, as seen in FIG. 1A, is generally seen to simulate the shape of a gun including a scope, stock, barrel, foregrip. The launch assembly also includes a housing assembly 12 and a trigger assembly mounted on the housing assembly. A combined mechanism 16, as best seen in FIG. 1B, providing a torsion booster spring 18 for energy storage and priming to assist an energy generating mechanism 20 driving projectile propelling flywheels 22 to assist and reduce operation time, ramping up speed, and sounds of the energy generating mechanism.

In the present described embodiment, the housing assembly 12 is generally made of a heavy-duty plastic material formed into a clam shell housing and includes a slot 24 into which a dart clip/magazine 26 is inserted, as seen in FIG. 1A. Darts 28 are housed in the dart clip/magazine and are ready for feeding, one at a time into the projectile propelling flywheels 22 to be launched one at a time in either a single shot mode or in rapid succession in a full auto mode. A pusher/feeding mechanism 27 is mounted onto the housing assembly and operates to feed darts into the launch channel 30 for engagement with the rotating flywheels or drive wheels propelling the darts.

A limit switch 32, hidden behind lever 31 as seen in FIG. 1A, is disposed within slot 24 for capturing the inserted dart magazine. Limit switch 32 is closed/inactivated when a dart magazine is inserted into slot 24 allowing power to the energy generating mechanism 20 and switch 32 is open/activated to cut off power to the energy generating mechanism 20 when dart magazine 26 is removed from slot 24. The Limit switch 32 operates to only allow the energy generating mechanism to be turned on when the dart magazine is fully inserted into the housing slot.

The energy generating mechanism 20 is mounted to the housing assembly and includes one or more motors, or a manual cocking/priming mechanism. The energy generating mechanism 20 is linked to the projectile propelling flywheels 22 to drive rotation of the flywheels for propelling or firing darts or other projectiles from the rapid-fire toy projectile launch assembly 10, as best seen in FIG. 1B. In the present described embodiment, the energy generating mechanism 20 includes a single motor which engages three items, the flywheels, torsion booster spring and pusher mechanism off one or more gear trains with the timing for each engagement being optimized for synchronization. A In the present described embodiment, the flywheels 22 include two opposed rotatable wheels which engage and advanced darts therebetween. Motor 21 drives rotation of flywheels 22 creating a launching force frictionally applied to the dart as the dart engages a wheel surface on each of the opposed rotatable wheels. The rotating wheels impart sufficient energy to the dart to launch the dart from the apparatus 10.

The motor 21 mechanically engages the flywheels 22 through a flywheel gear train 33 extending directly from the motor to the flywheels, as seen in FIG. 1B. Gears 34 and 36 are each coupled to a flywheel, as seen in FIG. 2, and are mechanically linked through the flywheel gear train 33 to the motor 21 for driving rotation of the flywheels.

Figure 2:
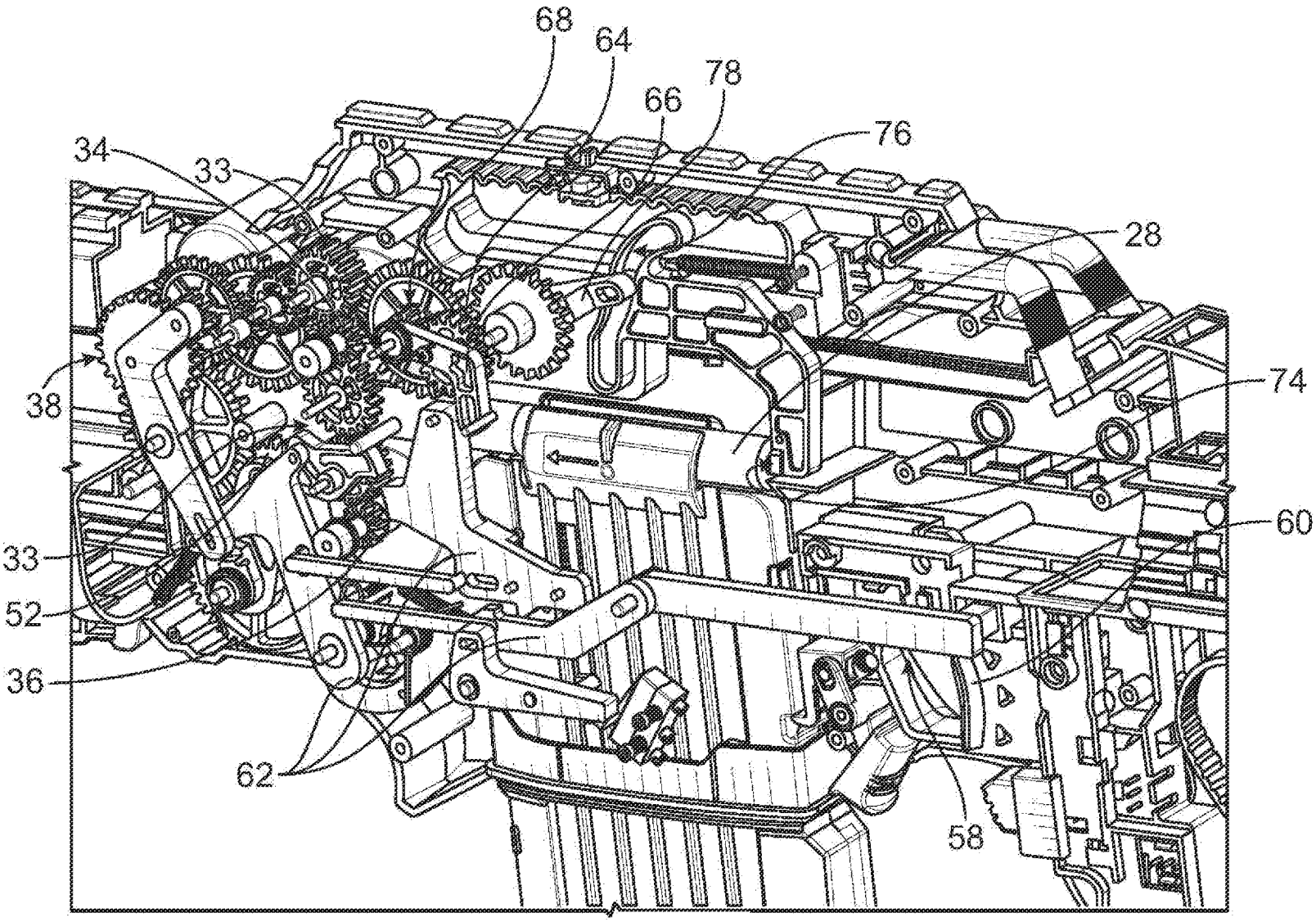
FIG. 2 illustrates a spring winding gear train and a flywheel gear train linking the torsion booster spring to a motor and the flywheels, respectively.

The motor 21 also mechanically engages the torsion booster spring 18 through a spring winding gear train 38 extending directly from the motor to the torsion booster spring, as seen in FIGS. 1-2. The torsion booster spring is mounted on a barrel gear 40, as best seen in FIG. 1B. The barrel gear 40 engages gears in the spring winding gear train 38 linking the mounted torsion booster spring to the motor for priming the booster spring to a charged disposition when the motor is turned on.

The barrel gear 40 is rotated by the motor through the spring winding gear train 38 which simultaneously primes the booster spring 18 to a charged disposition storing energy in the spring. The barrel gear 40 includes one or more priming stops 42 & 46 for retaining the barrel gear in a wound position and the mounted booster spring 18 in a primed/charged disposition. A spring barrel pawl 44 is mounted to the housing assembly adjacent the barrel gear and captures a priming stop 42 & 46 for maintaining the torsion spring in a charged disposition. The barrel pawl 44 is spring biased toward the barrel gear 40 to easily capture a priming stop as the barrel gear is rotated to a wound position and to more readily maintain the connection between the pawl and the stop until the pawl is mechanically removed from the stop by a user desiring to fire a dart.

The barrel gear 40 has multiple priming stops or ratchet positions allowing the torsion spring to be wound to various partially-primed positions in addition to a fully primed position, which drastically extends the use-time of the toy apparatus/blaster. If a battery of the apparatus is partially drained and cannot fully charge the torsion spring, the multiple priming stops will allow the torsion spring to capture one of the stops and at least partially charge/prime. A new battery will allow for the barrel gear and mounted torsion spring to prime to a fully charged disposition, and a partially drained battery will still allow for the barrel gear and mounted torsion spring to prime to a partially charged disposition.

In the present described embodiment, priming stop 46, maintains the torsion spring in a fully charged disposition, as seen in FIG. 1A, while priming stops 42 maintain the torsion spring in various degrees of charged disposition which are all less then fully charged when the spring barrel pawl 44 captures one of the priming stops 42, as seen in FIG. 1B. Capturing a priming stop 42 at a less then fully charged position allows the barrel gear 40 to wind the torsion spring with a battery drained to a sub-prime level. The lower prime levels of a battery will provide less of a boost to the flywheels when the torsions spring is only partially primed, but even the lowest level at which the torsion spring is primed will still provide for a quicker flywheel ramp-up than if the flywheels were accelerated by the motor alone and without the boost of the primed torsion spring 18. Additionally, a fully primed torsion booster spring will jump start the flywheels and provide enough flywheel rotation and power to fire off 2 or 3 darts/projectiles in use, while a less than fully primed torsion booster spring will still provide enough flywheel rotation and power to fire off at least one dart/projectile from the flywheels.

The torsion booster spring 18 engages the motor 21 through the spring winding gear train 38, as seen in FIGS. 1-2, and primed to a charged disposition when the motor is turned on. Immediately after the motor charges the torsion booster spring, the motor is temporarily shut off. In the present described embodiment, a micro-switch (not shown) linked to the motor and engaging the spring barrel pawl 44, shuts off power to the motor when the torsion spring is primed to a charged disposition. Alternatively, a time-delay circuit can be utilized for cutting power to the motor for a predetermined period-of-time after the torsion booster spring is primed to a charged disposition.

Figure 15:
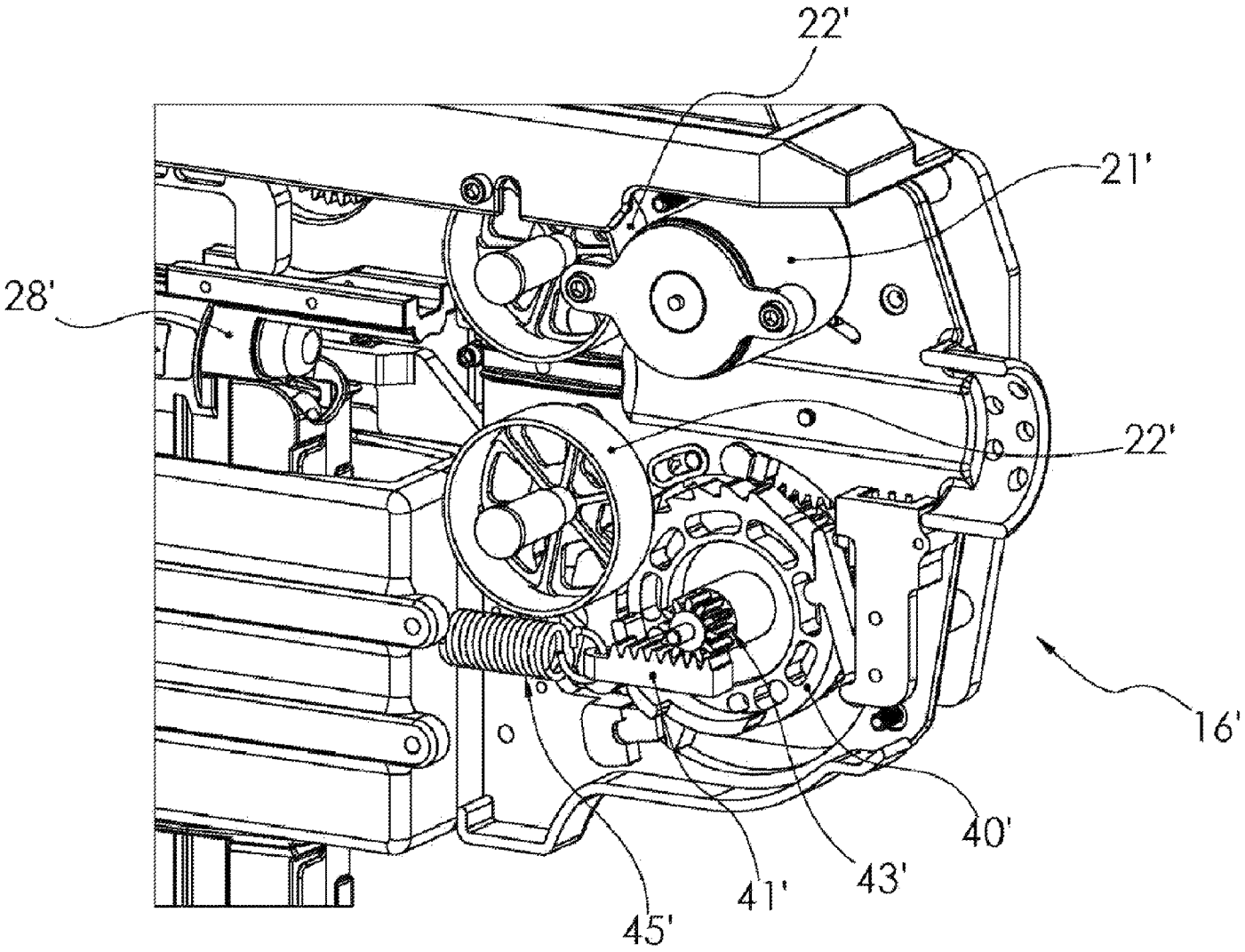
FIG. 15 illustrates a linear booster spring in an embodiment of the present invention.

In an alternative described embodiment, an apparatus 16', as seen in FIG. 15, includes a linear booster spring 45' acting through a rack and pinion gear, or can include an elastomeric element or the like, acting to enact a torque onto the system either directly through the flywheel mechanism or through a gearing structure such as a rack and pinion gear. The linear booster spring jump starts the flywheels to a desired rotational speed before projectiles/darts 28' are fed into the spinning flywheels. The linear booster spring 45' mechanically engages a rack 41' at one end and is fixed at another end of the spring. A pinion gear 43' rides along rack 41' and is mounted on a barrel gear 40' for rotation with the barrel gear. In use, the motor 21' mechanically engages the linear booster spring through a spring winding gear train which engages the barrel gear and mounted pinion gear 43' for priming the linear booster spring to a charged disposition when the motor is turned on.

The barrel gear 41' is rotated by the motor to a primed position, storing energy in the spring, in a similar manner as described above for the torsion booster spring. In the present described embodiment, and also in the alternative embodiment 16', the primed torsion booster and linear booster springs jump start flywheels utilizing the stored energy in the primed booster spring/torsion spring/linear spring rather than flywheel stored energy or relying purely upon the motor. The torsion booster spring 18, or linear booster spring 45' engage the flywheels 22/22' through a flywheel gear train 33, as seen in FIGS. 2-4 & 15. The flywheel gear train includes gear 50 which engages the torsion booster spring/linear booster spring and barrel gear 40/40' to jump start rotation of the flywheels before they are driven by the motor when the user desires to fire a dart 28/28'. Gear 50 transfers the stored energy from the primed torsion booster spring/linear booster spring to the rest of the flywheel gear train 33 and linked flywheels 22/22' to jump start rotation of the flywheels 22.

Figure 3:
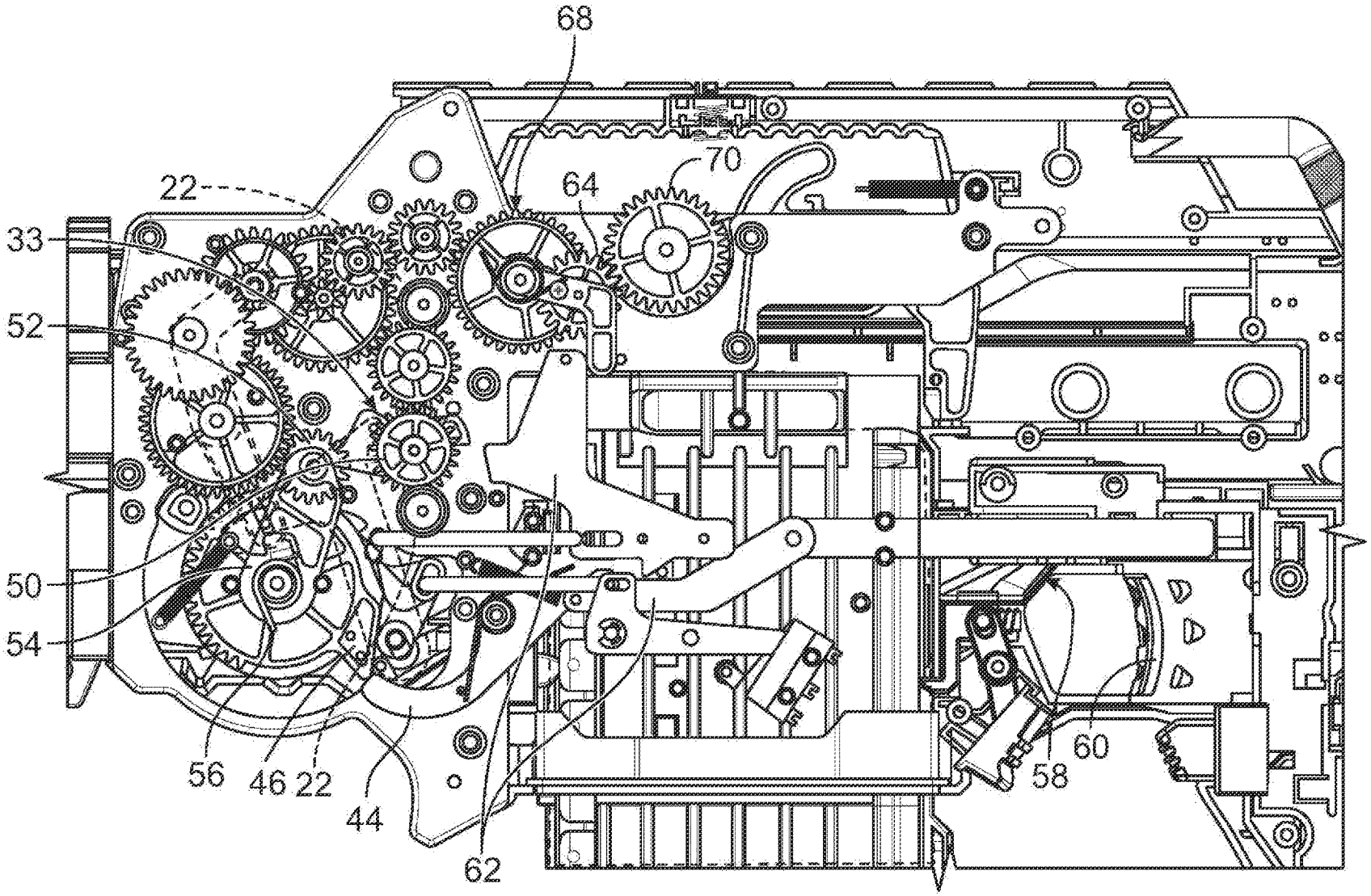
FIG. 3 illustrates the torsion booster spring coupled to a barrel gear and in a charged disposition after priming when the motor is turned on, FIG. 4 illustrates the first swing gear coupled to the barrel gear and in a first position engaging the spring winding gear train and linking the torsion booster spring to the motor.
Figure 4:
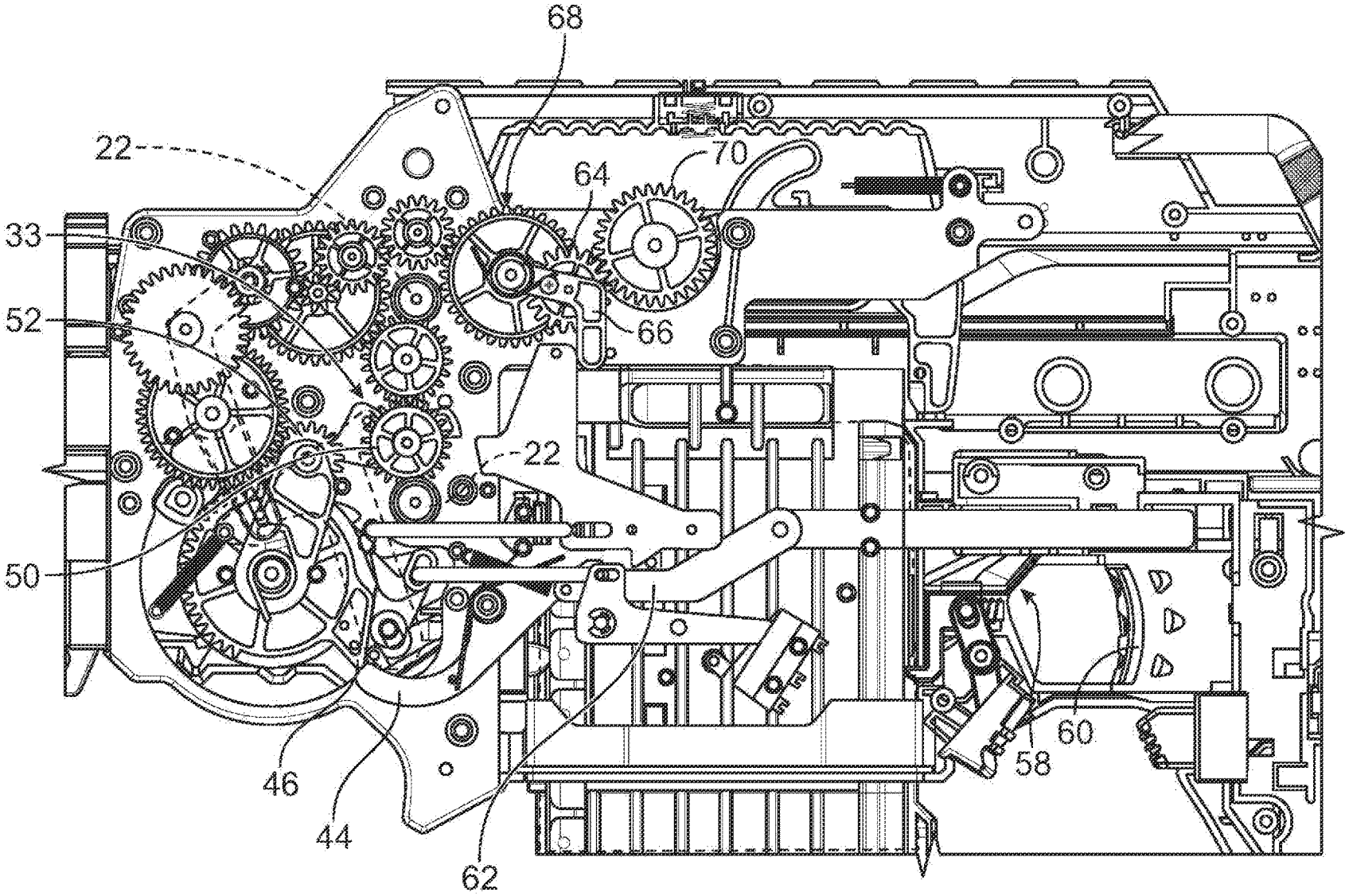
Figure 5:
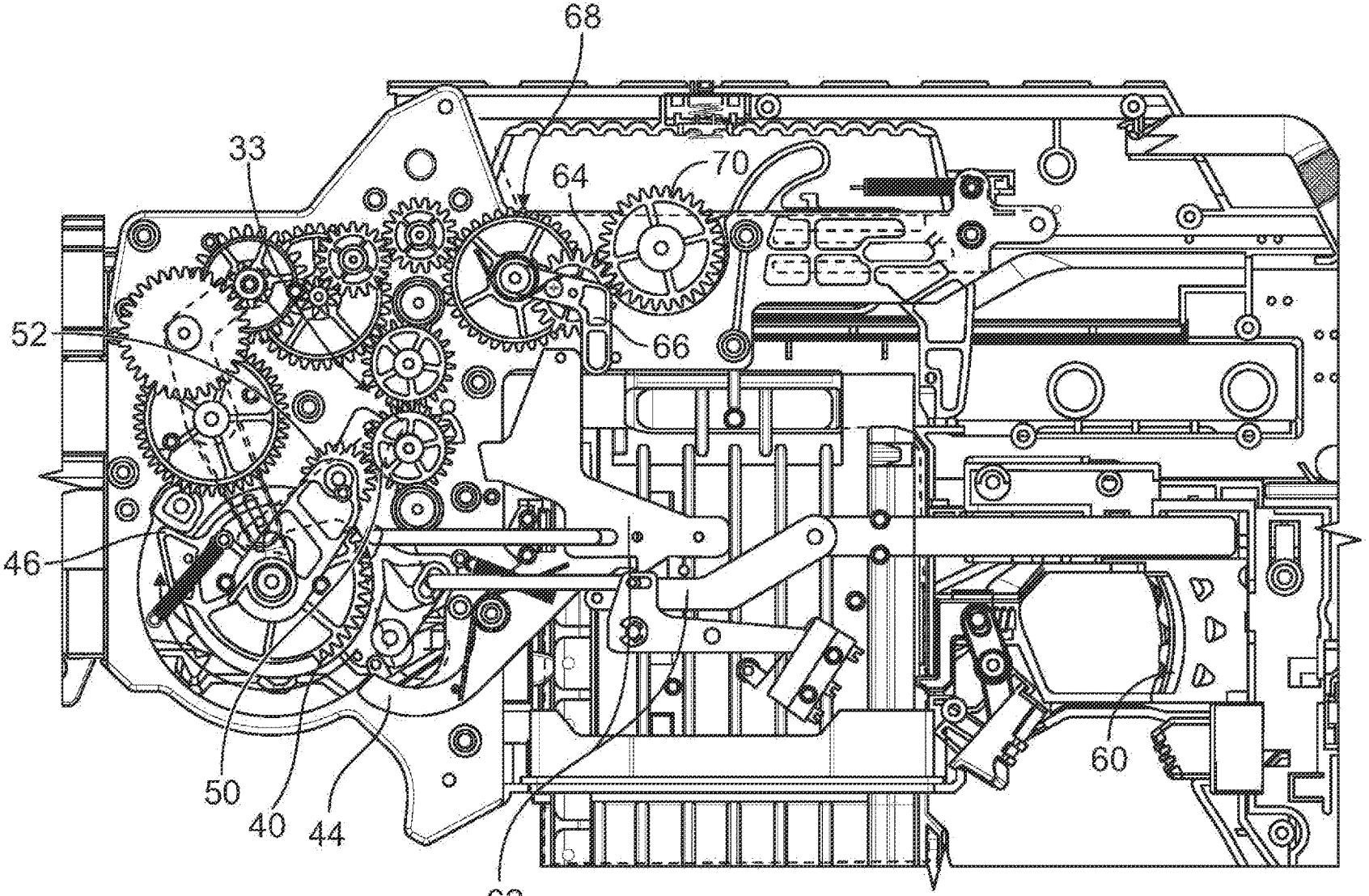
FIG. 5 illustrates the first swing gear in a second position linking the torsion booster spring to the flywheel gear train for dumping the stored energy of the torsion booster spring into the flywheels, and the second swing gear engaging the pusher mechanism to drive back and forth movement of the pusher mechanism, when the trigger is pulled.

In the present described embodiment, a first swing gear 52, as seen in FIGS. 3-5, couples to the barrel gear 40 and coupled torsion spring 18 and is operable to swing between first and second positions, for priming the torsion booster spring in the first position, as seen in FIGS. 3-4, and driving rotation of the flywheel gear train in the second position, as seen in FIG. 5. The torsion booster spring clutches either to the spring winding gear train 38 or the flywheel gear train 33 through the first swing gear 52. In the present described embodiment, the first swing gear couples to the barrel gear through a linkage arm 54 which is spring biased 56 toward the spring winding gear train 38 and driven by the spring winding gear train 38 to rotate when the motor is turned on.

Rotation of the first swing gear 52 winds the barrel gear 40 and primes the torsion spring 18 to a charged disposition. The first swing gear 52 shifts from engagement with the motor gear train and into engagement with the flywheel gear train to rapidly transfer/dump the stored energy from the primed torsion spring into the flywheels when the user desires to fire a dart. A trigger assembly 58, as seen in FIGS. 2-5, include a trigger 60 and a linkage assembly 62, for engaging the torsion booster spring 18 to rapidly transfer the stored energy from the charged torsion booster spring into the flywheels to assist the motor and jump start rotation of the flywheels before they are driven by the motor, when the trigger is pulled. In the present described embodiment, the linkage assembly 62 connects the trigger 60 to the barrel pawl 44 and the first swing gear 52, as seen in FIG. 2.

In use, when the motor is turned on, the spring winding gear train engages the first swing gear 52 and rotates the barrel gear 40 priming the torsion booster spring to a charged disposition. The barrel pawl 44 shifts into position to retain the booster spring 18 in a charged disposition, as seen in FIGS. 3 & 4. When the trigger is pulled, the linkage assembly 62 shifts barrel pawl from engagement with a barrel stop 42 & 46, and shifts the first swing gear into engagement with gear 50 of the flywheel gear train 33, rapidly transferring the stored energy of the booster spring 18 into the flywheels to jumpstart flywheel rotation, as seen in FIG. 5. Additionally, in the present describe embodiment, when the trigger is pulled, the spring winding gear train 38 disengages/unclutches from the motor and a blaster trigger microswitch (not shown) energizes the motor to sustain flywheel rotation beyond the initial transfer of stored energy of the primed torsion spring.

A second swing gear 64, as seen in FIGS. 2-5, is linked to the trigger assembly 58 through a linkage 66 and is operable between a first and second position. When the trigger is pulled, the second swing gear shifts to the first position shifting the second swing gear into engagement with the pusher mechanism 27, causing back and forth motion of the pusher mechanism for advancing projectiles into the flywheels. In the present described embodiment, the second swing gear 64 engages a pusher gear train portion 68 of the flywheel gear train 33 which is coupled to the motor, as seen in FIG. 2, and transfers rotation of the flywheel gear train 33 to gear 70 of the pusher/feeder mechanism 27, as seen in FIG. 5, actuating the pusher mechanism to advance projectiles into the rotating flywheels. Linkage 62 of the trigger mechanism mechanically engages linkage 66 of the second swing gear to shift the second swing gear 64 into contact with the pusher gear train portion 68 and gear 70 connecting the motor driven pusher gear train portion 68 of the flywheel gear train 33 to the pusher mechanism.

A single pull of the trigger 60 will advance at least one single dart (one at a time) into the rotating flywheels for a single shot mode, and a continuous hold of the trigger will continuously advance darts into the rotating flywheels for a full auto mode that will drain the dart magazine of darts. The flywheels continue to spin while the trigger is held down, as the motor is directly coupled to the flywheels. Release of the trigger will shift the second swing gear 64 to the second position disengaging the second swing gear from the pusher gear train portion 68 of the flywheel gear train 33 and gear 70 of the pusher mechanism.

Release of the trigger also automatically reengages the motor to the torsion booster spring through the spring winding gear train 38 as the first swing gear 52 automatically shifts back toward its biased first position, and the trigger is disengaged from the system until the spring is fully wound, or the torsion spring completes priming to a less than fully wound priming stop 42. The torsion spring is re-primed every time the trigger is released (reclaiming flywheel rotational energy).

The pusher/feeding mechanism 27, as best seen in FIG. 1B, is disposed adjacent the flywheels and engages the motor through engagement with the second swing gear for advancing projectiles into the flywheels one at a time. In the present described embodiment, as seen in FIGS. 1A & 2, a pusher arm 72 includes a pusher surface 74 for engaging an end of the dart/projectile 28 to push the darts/projectile into the rotating flywheels. The pusher mechanism also includes a cam surface 76, seen in FIG. 2, for engaging and directing a cam follow 78 which is coupled to gear 70. As gear 70 is rotated when engaging the second swing gear 64, cam follower 78 rides along cam surface 76 to translate the rotation motion of gear 70 to a back and forth motion of the pusher/feeding mechanism to push darts/projectiles into the rotation flywheels one at a time.

In the present described embodiment, a single motor is synchronized with the trigger assembly to drive priming of the torsion spring, rotation of the flywheels, and back and forth movement of the pusher mechanism. Use of one motor verses two or three to drive all the various mechanisms of the toy apparatus is novel and beneficial to reducing the cost of the toy apparatus. Additionally beneficial is the employment of two main gear trains and the shifting of a first and second swing gear to rapidly transfer the stored energy of the primed torsion booster spring to jump start the flywheels assisting the motor, and to drive the pusher mechanism to feed darts into the spinning flywheels launching darts from the apparatus 10.

How to use:

Step 1: Flip On/Off switch to "On" (Torsion spring is primed when the blaster is turned on, the spring is released with trigger pulled to jump start rotation of flywheels through gear train.)

Step 2: Pull Trigger to fire darts/hold trigger to auto-fire (When the trigger is pulled a switch is engaged to run the motor which maintains rotation of the flywheel. The switch stays engaged until the trigger is released.)

Step 3: Flip On/Off switch to "Off" when not in use (this system utilizes one motor to operate the winding of the torsion spring as well as the rotation of the flywheels, and the pusher is linked to the gear train of the Flywheels.)

Mechanism Steps:

1. On/Off switch is turned on—motor is energized and primes torsion spring (motor remains energized until shut off by a microswitch when spring fully/or partially primed)
2. Torsion spring is fully wound and flips switch to cut power to motor
3. Trigger is pulled—4 things happen
   1. Swing gear engages torsion spring to flywheels instead of spring winding gear train
   2. Barrel pawl is blown and torsion spring rapidly releases energy to flywheel gear train
   3. Spring winding gear train to torsion spring disengages from the motor and motor is energized by a blaster trigger microswitch to sustain flywheel rotation
   4. Second swing gear engages pusher mechanism and energizes pusher to begin dart advancement into the flywheels
4. Trigger is released—second swing gear disengages the pusher mechanism, dart advancement stops and motor engages torsion spring through spring winding gear train and disengages the trigger from the system until spring is fully re-primed, or the torsion spring completes priming at a less then fully wound position. Flywheel energy is reclaimed when re-priming spring, the rest is topped off by the motor. Motor and flywheels come to a halt and system is ready for next cycle.

5. On/Off switch is turned off—spring barrel pawl retracts and the torsion spring slowly discharges energy to dissipate through spring winding gear train at a large reduction and dampened by flywheels and motor, and blaster has no power.

When the user desires to shut down the rapid fire toy projectile motorized launch assembly 10, the On/Off switch 71, as seen in FIG. 1A, is turned off triggering the barrel pawl 44 to retract and dissipate the stored energy in the torsion spring into the flywheel gear train 33 and the launch assembly 10 will have no power. An alternative On/Off switch 75, as seen in FIG. 1B, may be coupled to a grip 73, adjacent the trigger 60, such that the On/Off switch is engaged when the grip is held by the user, for energizing the motor and priming the torsion booster spring. Disengagement of the grip by the user will switch the launcher off.

Figure 6A:
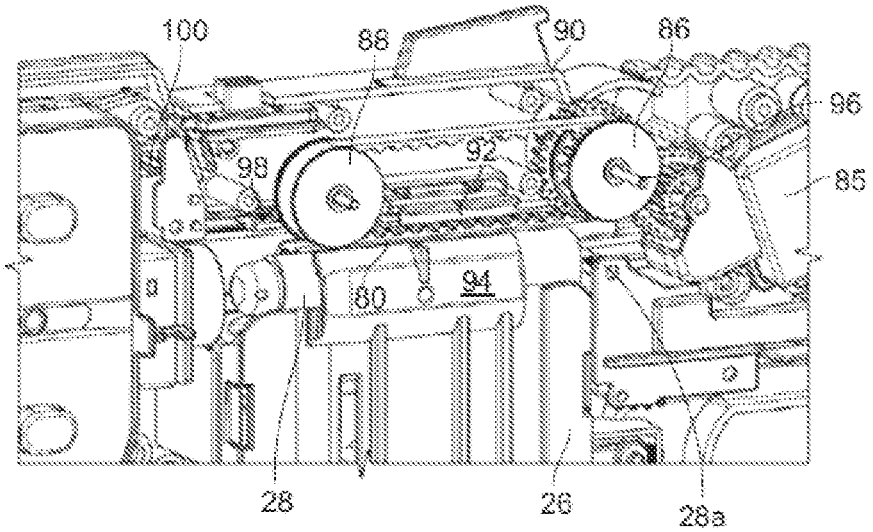
Figure 6B:
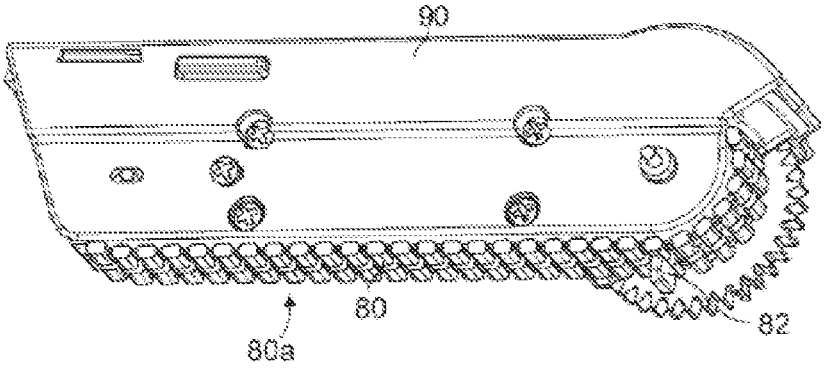
FIG. 6B illustrates an alternative belt of the feeding mechanism partially contained within a clamshell housing.

An alternative pusher/feeding mechanism, as seen in FIGS. 6A & 6B, includes a continuous belt 80 rotating a protrusion element 82 into contact with a rear surface 28*a* of a dart/projectile 28. The alternative pusher/feeding mechanism includes two pulleys 86 & 88 disposed apart from one another and supporting belt 80 stretched therebetween. The pulleys each include a coaxial gear within for mating with a toothed inner surface of the belt for securely driving rotation of the belt around the pulleys. The alternative pusher/feeding mechanism may require more than one motor to drive rotation of the pulley elements etc.

A clamshell housing 90 partially contains belt 80 and pulleys 86 & 88, and a separate pulley motor 85 drives rotation of the belt between pulleys 86 & 88. The pulley motor 85 is disposed within the apparatus housing assembly 12 and rotates pulleys 86 & 88 and belt 80 in a clockwise direction. A biasing plate 92 urges belt 80 into an inserted magazine 26 and with an outermost surface 80*a* of the belt gliding along the uppermost dart 28 residing in the magazine and urging the uppermost dart away from contact with retaining lips 94 and into a releasing position. Continuous rotation of the belt 80 rotates protrusion elements 82 into contact with the now accessible rear advancing surface 28*a* of the leveled dart in the releasing position and advances the dart into the energy generating mechanism/flywheels, which fires the dart from the toy launch apparatus 10.

The clam shell housing 90 of the alternative feeding mechanism opens into the inserted dart magazine 26 with the biasing plate 92 and belt 80 protruding from the clamshell housing 90. The clam shell housing 90 is inserted into the toy launch apparatus adjacent a gear train linked to the pusher motor and is pivotably coupled to the housing 12 assembly. Axel 96 is seen in FIG. 6A, illustrates where clam shell housing 90 can pivot a jam door to clear any objects from inside the toy launch apparatus. FIG. 6B represents an alternative embodiment where belt 80 may be employed without plate 92, and include a ribbed outer surface of the belt, and the further alternative embodiment may avoid the biasing plate 92 with alternate support, supporting mechanism, pulleys, gears or the like to maintain continued contact of pushing belt or chain with the protrusion 82 contacting the rear advancing surface 28*a* of the dart as it is pushed forward.

A sliding lock 98 is disposed at the clam shell housing and is in a locked position to maintain the housing 90 and contained feeding mechanism in proper engagement with the dart magazine and other presently described mechanisms of the toy launch apparatus. A limit switch 100 is closed/inactivated when the sliding lock 98 is in a locked position maintaining a proper connection between the motors and a power supply to keep the motors running. Alternatively, when the sliding lock is in an unlocked position in order to pivot the clam shell housing 90 away from the apparatus housing 12, the limit switch 100 is open/activated blocking the power supply to the motors and preventing the motors from running when the jam door is open.

The alternative pusher mechanism can include one or more motors to drive rotation of the flywheels and the pulley's 86 & 88, as seen in FIGS. 6A & 6B. In use, a trigger pull by a user activates one or more motors which drive the energy generating mechanism/flywheels. The two opposed rotatable flywheels, engage and advanced darts therebetween with the flywheel motors creating a launching force frictionally applied to the dart 28 as the dart engages a wheel surface on each of the opposed rotatable wheels. The rotating wheels impart sufficient energy to the dart to launch the dart from the toy launch apparatus. The trigger pull will also activate the pulley motor 85 driving rotation of the continuous belt 80 rotating a protrusion element 82 into contact with a rear surface 28*a* of a dart/projectile 28 feeding the dart into the flywheels to launch from the toy apparatus 10.

An alternative energy generating mechanism 20 includes a manual cocking/priming mechanism which engages a torsion booster spring through a spring winding gear train to prime the spring to a charged disposition by manually cocking the priming mechanism. The torsion booster spring engages the flywheels through a flywheel gear train and a pusher mechanism is disposed adjacent the flywheels for advancing projectiles into the flywheels one at a time. A trigger assembly including a trigger and linkage assembly for engaging the torsion booster spring and the pusher mechanism, rapidly transferring stored energy from the charged torsion booster spring into the flywheels to rotate the flywheels, and actuating the pusher mechanism to advance a projectile into the rotating flywheels when the trigger is pulled to fire off a single dart/projectile.

A barrel gear for mounting the torsion booster spring and engaging with the spring winding gear train is included, and the barrel gear includes one or more priming stops. A spring barrel pawl is biased toward the barrel gear and coupled to the trigger assembly for catching one or more stops of the barrel to retain the torsion booster spring in a primed position until the trigger is pulled. Additionally, a first swing gear is coupled to the torsion booster spring and operable to swing between first and second positions, including a first position with the swing gear engaging with the spring winding gear train to prime the torsion spring to a charged disposition when the priming mechanism is manually cocked, and a second position shifting the swing gear away from the spring winding gear train and into engagement with the flywheel gear train for transferring the stored energy of the primed torsion spring into the flywheels when the trigger is pulled.

Further, a second swing gear is linked to the trigger assembly and operable between a first and second position, with the first position including the second swing gear swinging into engagement with the pusher mechanism causing back and forth motion of the pusher mechanism advancing projectiles into the flywheels when the trigger is pulled, and the second position including the second swing gear disengaging from the pusher mechanism when the trigger is released. Similar to the present described embodiment above which includes a motor as the energy generating mechanism, the alternative energy generating mechanism including a manual cocking/priming mechanism operates to fire darts/projectiles with the same elements excluding only the motor of the motor driven energy generating mechanism 20.

Figure 8:
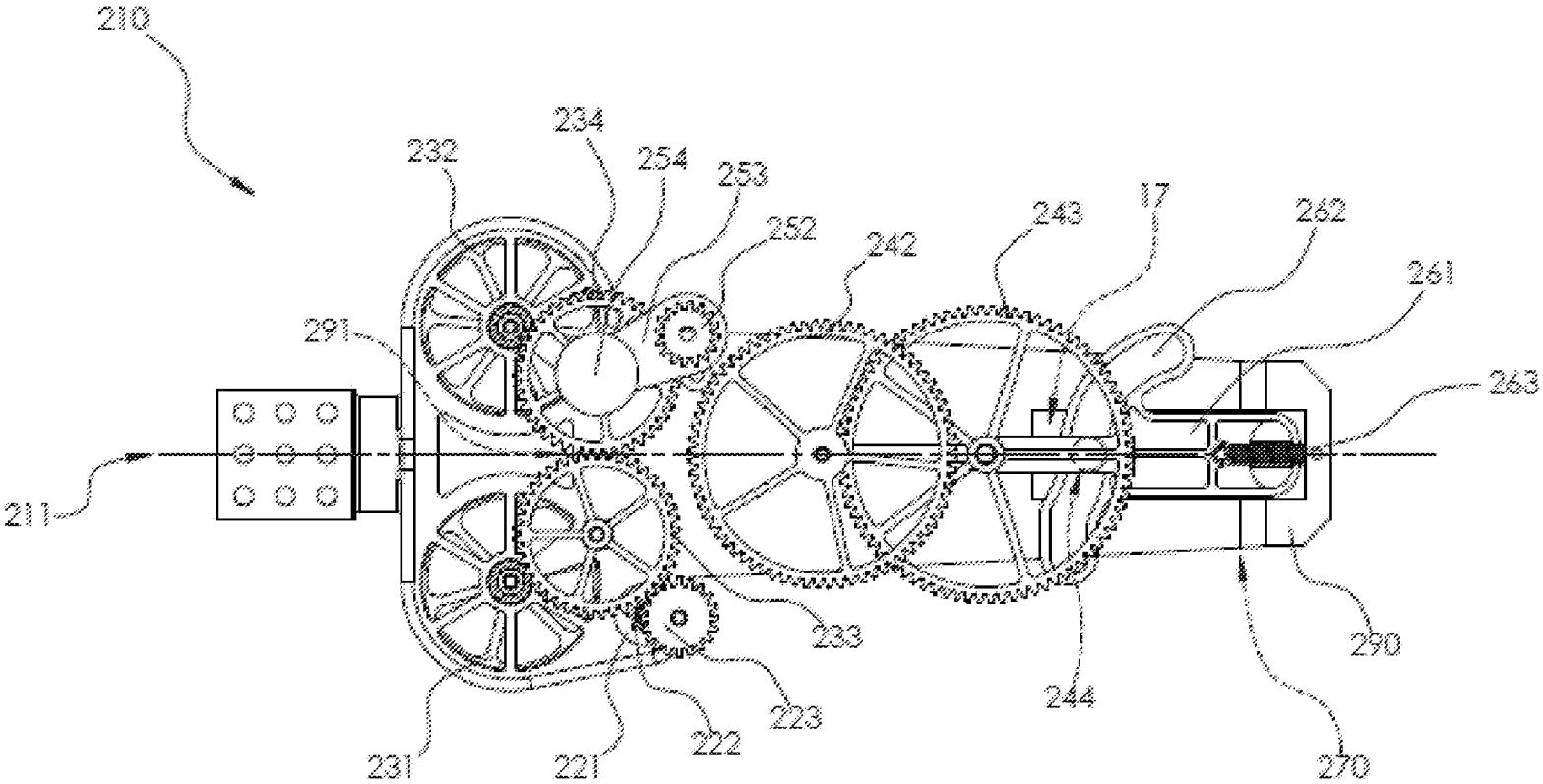
FIG. 8 is an undercarriage view of a single-motor projectile-launching apparatus in accordance with an embodiment of the present invention including an actuated-clutch structure engaging a projectile-feeding mechanism.

In alternative described embodiments, as seen in FIGS. 7 & 8, a single motor and clutch structure initiate the projectile pusher/feeding mechanism, when and only, after the rotating flywheels have reached a desired projectile launching rotational speed. Without the use of a torsion spring to jump start the motor, these presently described alternative embodiments need only a single motor and a clutch structure to sequence and actuate rotation of the flywheels as the propelling mechanism and communicate transmission of a gear assembly to activate the pusher/feeding mechanism to advance projectiles into the rotating flywheels for launching.

FIG. 7 is an under-carriage view of a single-motor projectile-launching apparatus in accordance with an embodiment of the present application including a centrifugal-clutch-engaged projectile-feeding mechanism. FIG. 7 illustrates an embodiment where the second idler-gear 234 is meshed to the input of a centrifugal-clutch 251. The output of the centrifugal-clutch 251 is meshed to the input of the compound-gear 242 engaged to transfer power from the motor to projectile feeder. As the centrifugal-clutch 251 mechanism spins with its expansion therein provides speed sensing for an achieved clutching delay. The centrifugal-clutch 251 is configured such that it is normally-disengaged and self-engages when the flywheels 231 and 232 have achieved a desired rotational speed allowing for the transfer of mechanical power from the motor 221 to the projectile-feeder 261 via the idler-gears 233 and 234, compound-gear 242, and follower-gear 243 for launching the dart 217 in the usual way. The projectile-feeder 261 is biased into a retracted-position toward the end of the housing 290, distal to the flywheel assembly 230 by a spring 263 such that the projectile-feeder 261 can freely engage and shuttle a dart 217 from the chamber 277. The centrifugal-clutch 251 is also arranged such that the projectile-feeder 261 returns to and remains in its retracted-position when the centrifugal-clutch 251 is disengaged.

The present described embodiment, as seen in FIG. 7, employs a single-motor and a centrifugal-clutch to initiate the projectile-feeding mechanism when or after the rotating flywheels have spun-up to desired projectile-launching rotational speed. The centrifugal clutch is located between the flywheel-drive system and the projectile-feed mechanism. In comparing the present described embodiment to a projectile launching apparatus not employing a clutch (to achieve a desired delay) the clutch of the present described embodiment initiates the feeding of projectiles only after the desired rotational speed of the flywheels has been achieved, thereby building in a desired delay while employing only a single motor driving both the flywheel drive system and projectile feed mechanism.

In use, a trigger is pulled by a user, initiating a five-part cycle that repeats while the trigger is activated. First, electrical power is provided to the single-motor, second, the flywheels are rotated through a gear-train to a desired projectile-launching rotational speed, third, a centrifugal-clutch self-activates and initiates the projectile-feeding mechanism to inject projectile into launch-channel, fourth, a projectile engages the flywheels and is launched, and fifth, the projectile-feeder returns to a retracted-position and engages another projectile for launching. When the trigger is released by a user, five-part cycle will initiate. First, the motor will continue to receive electrical power, second the system waits for the projectile-feeding mechanism to complete injection of a projectile into flywheels (sensor or other detection element monitors position of projectile-feeder), third, electrical power is cut to the motor or motor is braked or motor is reversed, forth, the centrifugal-clutch self-deactivates, fifth, the projectile-feeder returns to a retracted-position to engage another projectile for transfer.

The present described embodiment employs a centrifugal clutch located between the flywheel-drive system and the projectile-feed mechanism. A centrifugal clutch is essentially a simple mechanical speed sensor, which in this case allows gear 251 (FIG. 7) to slip until a predetermined rotational speed has been attained, at which point the gear stops slipping and begins transferring rotation to the adjacent gear (242). The centrifugal clutch ensures that the projectile-feed system is not activated until the flywheels have reached their full speed. This facilitates the speed of the projectile-feed system as being no longer limited by the start-up speed of the flywheels. For example, if it is determined that the motor can bring the flywheels fully up to speed from a standing start in 0.5 seconds, but that the flywheels are subsequently capable of handling a feed-rate of 0.2 darts per second after they are up to speed, then the gear ratio of the feed-system can be designed to operate at the faster feed-rate of 0.2 darts per second, while the centrifugal clutch ensures that the feed-system is not activated until the flywheels have passed through the 0.5 second start-up phase. In effect, the present described embodiment allows the system to launch darts at a higher rate-of-fire, which may enhance the play-value.

It is also contemplated that the present described embodiment, as seem in FIG. 7, can employ a mechanically actuated-clutch to initiate the projectile-feeding mechanism which may be manually mechanically actuated when the trigger is pressed/activated by the user, after a flywheel-button is activated by the user, to provide power to the motor and spin-up the flywheels.

In use, First, a flywheel-button is activated by a user initiating electrical power to the single-motor and rotating the flywheels through a gear-train to a desired projectile-launching rotational speed. Second, a trigger is depressed/activated by the user initiating a three-part cycle which repeats while fire-button is activated. First, a clutch is engaged and transmits mechanical power to the projectile-feeding mechanism to inject projectile into launch-channel, second, a projectile engages the flywheels and is launched, third, the projectile-feeder returns to a retracted-position to engage another projectile for transfer.

When the trigger is released by the user, a four-part cycle is initiated. First, the motor continues to receive electrical power, second, the system waits for the projectile-feeding mechanism to complete injection of a projectile into the flywheels through a sensor or detection element, third, electrical power is cut to the motor and the clutch is de-activated, and forth, the projectile-feeder returns to a retracted-position to engage another projectile for transfer. Next, de-activation of the flywheel-button causes, first, the motor continues to receive electrical power, second, the system waits for the projectile-feeding mechanism to complete injection of a projectile into the flywheels through a sensor or detection element, third, electrical power is cut to the motor or motor is braked or motor is reversed and clutch is de-activated, and forth, the projectile-feeder returns to retracted-position to engage another projectile for launching.

Employing a mechanically actuated-clutch to initiate the projectile-feeding mechanism creates a system similar-to the present described embodiment, as seen in FIG. 7, but it replaces the centrifugal clutch with an actively-controlled clutch. This approach provides the same benefit as the centrifugal clutch, in that it's possible to have a time-between-shots (or rate-of-fire) that's faster than the initial start-up time of the flywheels. However, it provides the added advantage of allowing the user to start the flywheels and maintain them at full speed indefinitely without the dart-feeder system being activated. With this arrangement, the launcher can be made to fire the first dart on much shorter notice, since the flywheels may already up to speed when the projectile-feed system is activated. To give a practical example, imagine that the user is aware that a target might be appearing at any moment, and they wish to be prepared to launch a projectile with the shortest possible delay. In such a case, the user might elect to energize the flywheels and bring them up to full operating speed, and then leave the system running in that state. Then, when a target subsequently appears, the user simply needs to actuate the clutch, which immediately activates the projectile-feed system. This approach allows for a much quicker first shot than if the user had to wait for the flywheels to first come up to speed before they were able to fire. The disadvantage of this embodiment is that a separate actuator is required to drive the clutch, which increases the overall cost and weight of the system.

In the alternative described embodiment, as seen in FIG. 8, a single motor and clutch structure initiate the projectile pusher/feeding mechanism, when and only, after the rotating flywheels have reached a desired projectile launching rotational speed, as was seen in FIG. 7, however, the described embodiment, as seen in FIG. 8, employs an actuated-clutch engaged projectile-feeding mechanism. The present described embodiment does not employ a torsion spring to jump start the motor, and only employs a single motor and an actuated-clutch structure to sequence and actuate rotation of the flywheels as the propelling mechanism and communicate transmission of a gear assembly to activate the pusher/feeding mechanism to advance projectiles into the rotating flywheels for launching.

FIG. 8, is an under-carriage view of a single-motor projectile-launching apparatus in accordance with the present described embodiment including an actuated-clutch-engaged projectile-feeding mechanism. FIG. 8 illustrates the second idler-gear 234 meshed to the input of a compound swing-gear 252. The swing-gear 252 is rotatably attached to a swing-arm 253 which pivots about the second idler-gear's 234 rotational axis. An actuator and return-spring assembly 254 is positioned at the swing-arm's 253 rotational axis. The actuator and return-spring assembly 254 biases the swing-arm 253 and attached swing-gear 252 away from engagement with the compound-gear 242 when the actuator and return-spring assembly 254 is not receiving electrical power from the power and control electronics, via an electrical connection. Accordingly, trigger activation by a user is achieved allowing speeding up and shooting anytime via trigger actuator with return-spring assembly 254 to clutch manually if desired. When electrically powered, the actuator and return-spring assembly 254 brings the swing-gear 252 into mesh with the input of the compound-gear 242 allowing for the transfer of mechanical power from the motor 221 to the projectile-feeder 261 via the idler-gears 233 and 234, compound-gear 242, and follower-gear 243 for launching the dart 217 in the usual way.

In another present described alternative embodiment, as seen in FIGS. 9-13, a quick start flywheel mechanism, for a toy projectile launcher apparatus 310, provides a full-auto flywheel blaster employing only a single motor and a clutch structure. Many conventional blasters employ three motors in order to rotate two flywheels and drive a projectile/dart feeder mechanism, however the present described embodiment, as seen in FIGS. 9-13, a unique and mechanically simple system provides a light weight and cost efficient blaster with all the speed and power of a conventional full-auto flywheel blaster. Motors are typically the most expensive component in a toy blaster making the employ of only a single motor as compared to two or three, a cost savings benefit to the present described embodiment as seen in FIGS. 9-13. Additionally, clutch structures, including a centrifugal clutch mechanism, are low cost components and employed in the present described embodiment, provide the additional benefit of eliminating the need for a second "accelerator" trigger which is also typically employed with conventional fly-wheel blasters, as well as simplifying the present described embodiments blaster's interface with the user.

In the present described embodiment, as seen in FIGS. 9-13, a single motor 312 powers a pair of rotating projectile propelling flywheels 314 (a propelling mechanism) and a pusher/feeding mechanism 318 for advancing projectiles/darts 319 into the flywheels for launching/firing. The pair of projectile propelling flywheels are linked to the motor, with a first of the pair, the direct flywheel, mechanically coupled to the motor and the second of the pair linked to the motor though a fly wheel gear train. The pusher mechanism 318 is disposed adjacent the pair of flywheels and engaging the motor 312 through a pusher/feeding gear train for advancing projectiles into the flywheels one at a time.

The flywheel gear train includes idler gear 324 in mechanical communication with an attached gear 313 at the first direct drive fly wheel. Further, idler gear 326 is in mechanical communication with both idler gear 324 and attached gear 315 at the second flywheel, as seen in FIG. 9. Motor 312 rotates the first coupled direct flywheel and attached gear 313, transferring the rotational power to idler gears 324 & 326 and then to the attached gear 315 at the second fly wheel, such that the motor rotates of the pair of flywheels simultaneously and at the same speed.

Activation of the motor and rotation of the flywheels is controlled by a user. A trigger 320 at a grip 319 of the toy projectile launcher apparatus 310 is depressed by the user which activates a switch 321 within a housing of the launcher to signal activation of the motor and rotation of the pair of flywheels, as seen in FIG. 9. Also, the single motor 312 is powered by batteries 311 secured to the housing of the toy projectile launcher apparatus.

Figure 10:
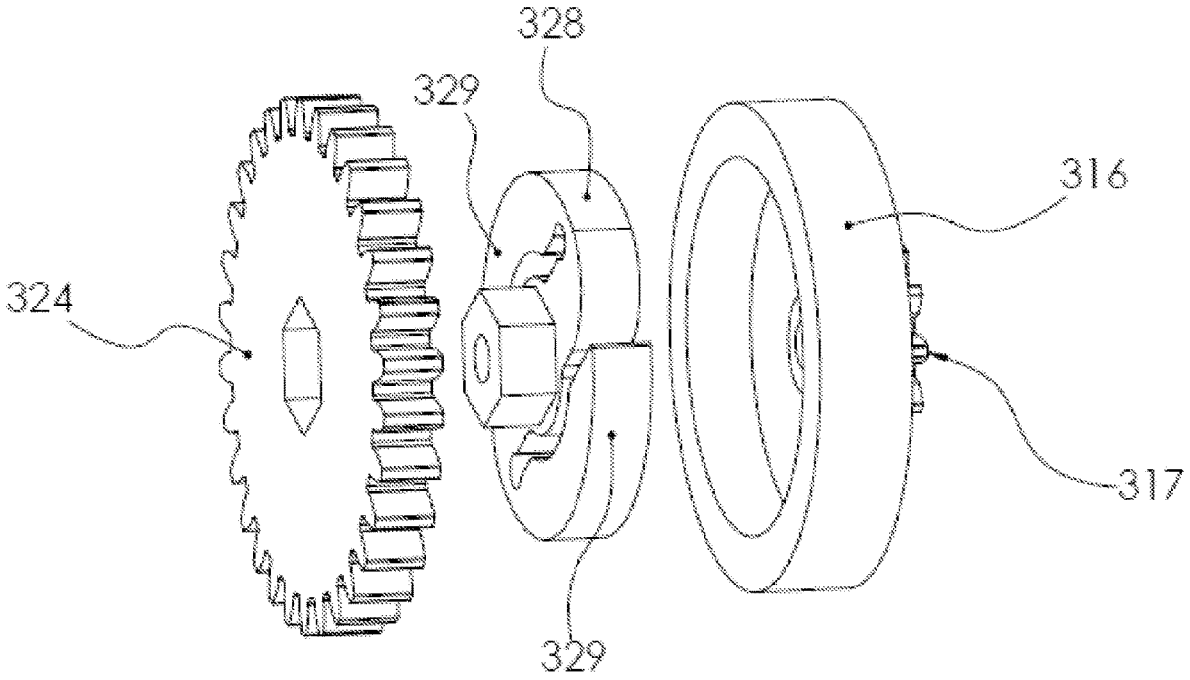
FIG. 10 is an exploded view of a centrifugal clutch structure.

A clutch structure engages the flywheels and the motor through the flywheel gear train. In the present described embodiment, as seen in FIGS. 9 & 10, the clutch structure 316 is a centrifugal clutch and is coupled to idler gear 324 to initiate the pusher/feeding mechanism upon the flywheels achieving a desired rotational speed for propelling projectiles. The centrifugal clutch includes a central element 328 with a pair of centrifugal arms 329 contained within the clutch structure housing/drum 316.

Figure 11:
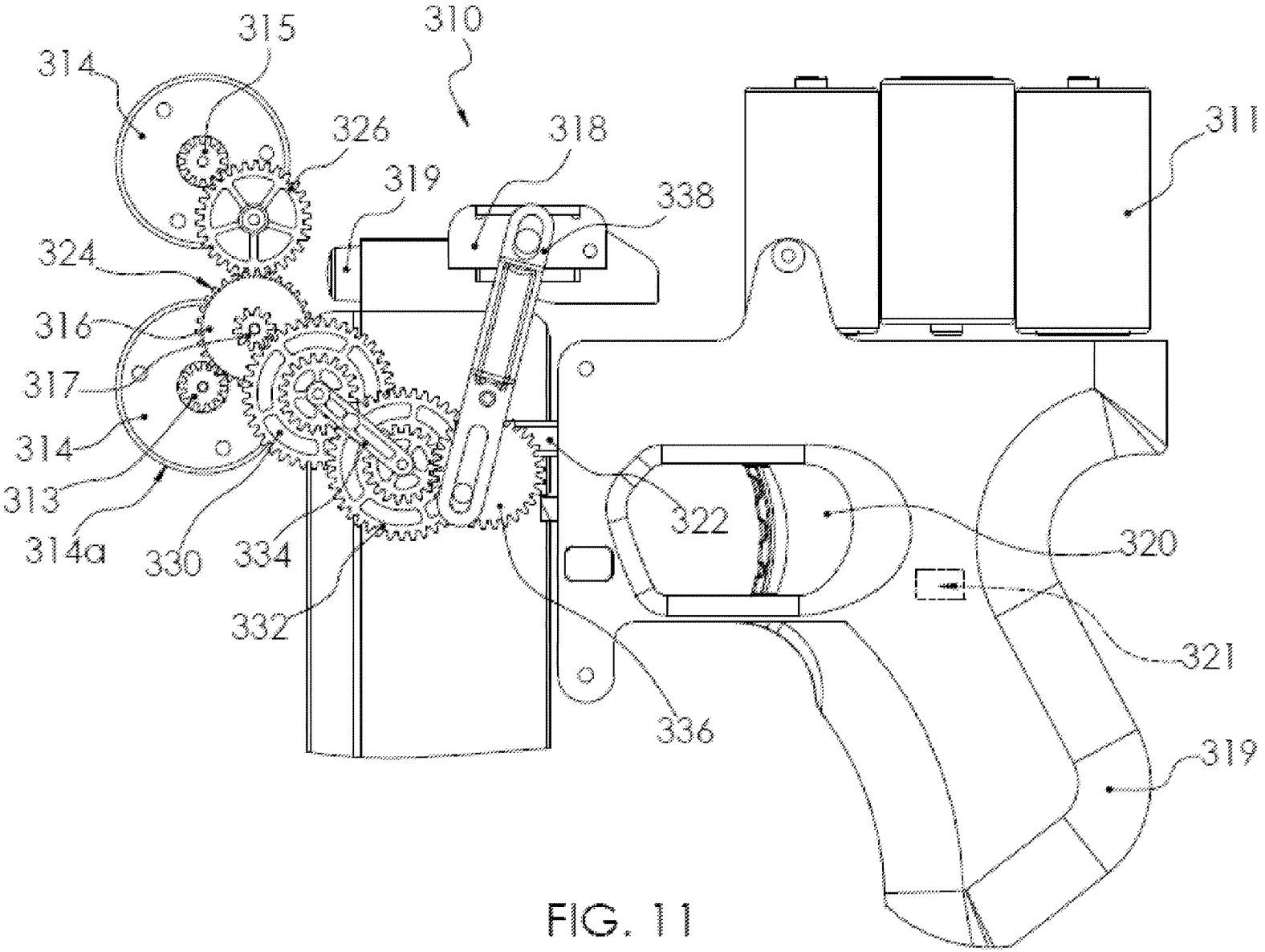
FIG. 11 illustrates a swing gear of a dart-feeder gear train pulled into mechanical engagement with crank gear for driving back and forth movement of the pusher/feeding mechanism when the trigger is pulled.
Figure 12:
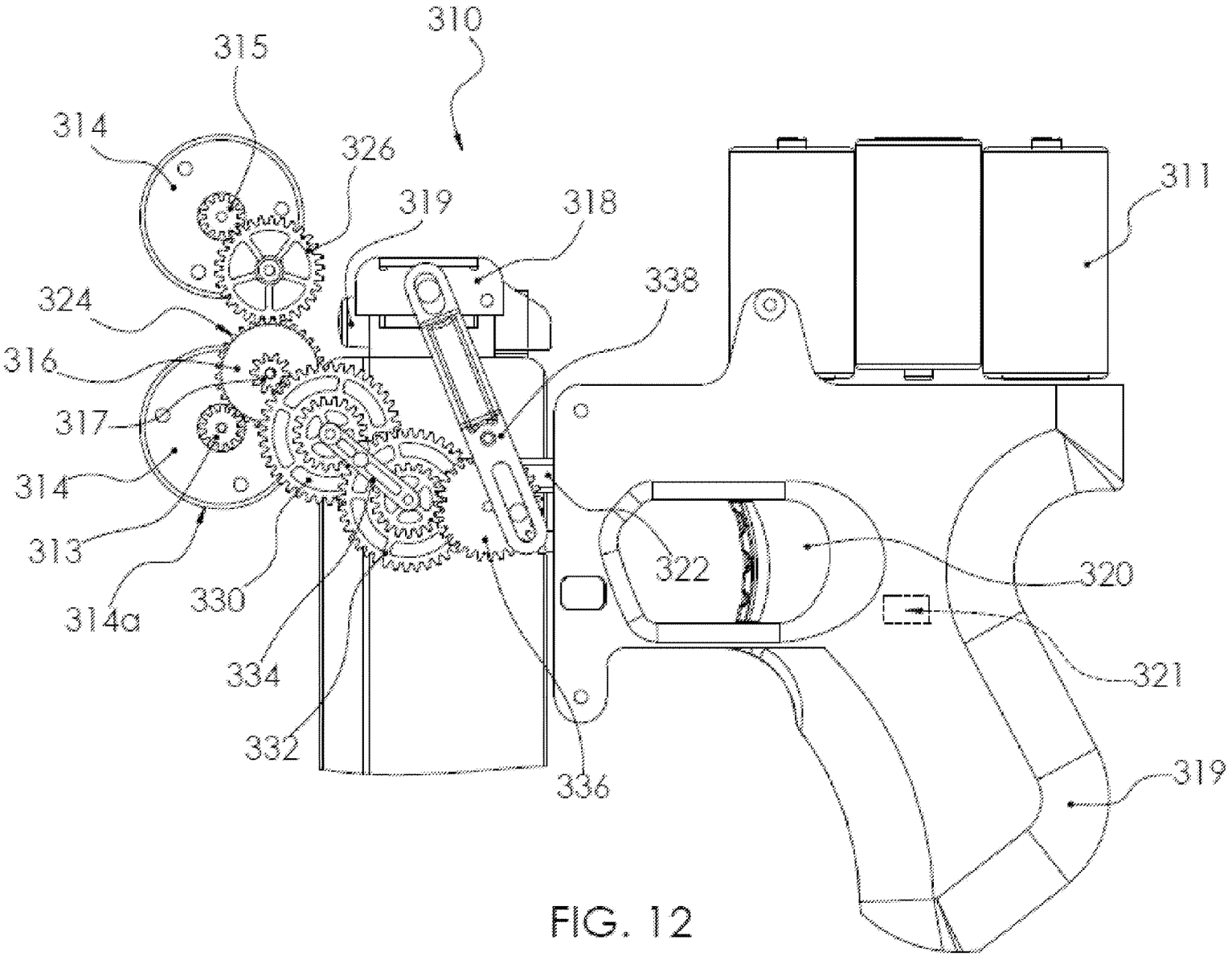
FIG. 12 illustrates a pusher/feeding linkage in mechanical communication with the crank gear at one end and the pusher/feeding mechanism at an end opposite, such that the rotatory motion of the crank gear is converted to a reciprocating motion of the linkage and coupled pusher/feeding mechanism.

The Idler gear 324 is coupled to the central element 328, as seen in FIG. 10, such that the central element 328 will rotate along with idler gear 324. The centrifugal clutch housing/drum 316 includes an attached gear 317 which engages a pusher/feeding gear train to transmit power to the pusher/feeding mechanism 318. The clutch structure also includes a swing gear operable between first and second positions for selectively driving the pusher/feeding mechanism 318, as seen in FIGS. 11&12. The swing gear links the pusher/feeding gear train to the centrifugal-clutch.

The pusher/feeding gear train, as seen in FIG. 9, includes a stationary scotch gear 330, sandwiched between the attached gear 317 of the clutch structure and the swing gear 332. The swing gear 332 is securely coupled to the scotch gear 330 through swing linkage 334. The swing linkage 334 is attached at one end to a central point of the scotch gear 330 and at an opposite end to a central point of the swing gear. The swing linkage pivots at the attachment point on the stationary scotch gear and acts as an arm secured to the swing gear allowing the swing gear 330 to securely shift between first and second positions. The swing gear 330 is spring biased to the first position.

Further included in the pusher/feeding gear train is a crank gear 336 which pivotably couples to a pusher linkage 338. One end of the pusher linkage 338 engages the crank gear in a cam and follower arrangement and the opposite end of the pusher linkage 338 pivotably engages the pusher/feeding mechanism 318. The crank gear rotates shifting the pusher linkage back and forth in a reciprocating fashion as it rides along a pin affixed to the crank gear when the swing gear mechanically engages the crank gear powered by the motor operating to sequence and activate the pusher/feeding mechanism and fly wheel propelling mechanism. The pusher/feeding mechanism 318 is disposed adjacent the pair of flywheels and engaging the motor 312 through the pusher/feeding gear train for advancing projectiles into the flywheels one at a time.

A trigger assembly including a trigger 320 and trigger linkage assembly 322 is linked to the swing gear 332 and engages the clutch structure 316 and the pusher/feeding mechanism 318. The trigger assembly jump starts rotation of the flywheels to an operating speed and activates the clutch structure when the flywheels are rotating at the operating speed, shifting the swing gear into the second position for actuating the pusher/feeding mechanism causing back and forth motion of the pusher/feeding mechanism advancing projectiles into the rotating flywheels when the trigger is pulled.

In use, the trigger is depressed/pulled by the user activating a switch 321 which resides within the housing of the toy launching apparatus 310 adjacent the trigger. The switch 321 activates the motor and begins driving rotation of the propelling flywheels. The depressed trigger linkage 332 also pulls the swing gear 332 into engagement with the crank gear 336, as seen in FIG. 11. The flywheel gear train and flywheels rotate immediately upon depression of the trigger and activation of the switch 321, however the centrifugal clutch and pusher/feeding gear train is not immediately powered and does not immediately rotate.

The pair of flywheels accelerate to an advancing speed along with idler gear 324 and coupled central element 328. Not until the flywheels achieve an operating speed will the centrifugal clutch drive power to the pusher/feeding gear train. At operating speed, the arms 329 of the rotating central element will flex outward and grip against the clutch structure housing 316 engaging the clutch housing and attached gear 317 to now rotate with the idler gear and flywheels. The centrifugal clutch will rotate with the flywheels and flywheel gear train at the operating RPM (approximately ~2 seconds) and transmit torque to the rest of the system, including the pusher/feeder gear train and pusher/feeding mechanism to allow projectiles/darts to be launched/fired only when flywheels are at full operating speed.

Depression of the trigger above, has already caused the trigger linkage assembly to pull the swing gear 332 into engagement with the crank gear 336. The stationary scotch gear and swing linkage 334 hold the swing gear securely in the second position, as seen in FIGS. 11 & 12. The centrifugal clutch is now operating and driving power to the pusher/feeder gear train and transmitting power to the crank gear which rotates with the coupled pusher linkage 338 driving the reciprocating pusher/feeding mechanism in a back and forth motion feeding projectiles/darts into the rotating flywheels one at a time, as seen in FIGS. 11 & 12. Continued depression of the trigger by the user, as in a full auto mode, will continually power the motor, flywheels and the pusher/feeding mechanism for a continuous stream of projectiles/darts firing from the toy projectile launcher apparatus.

Figure 13:
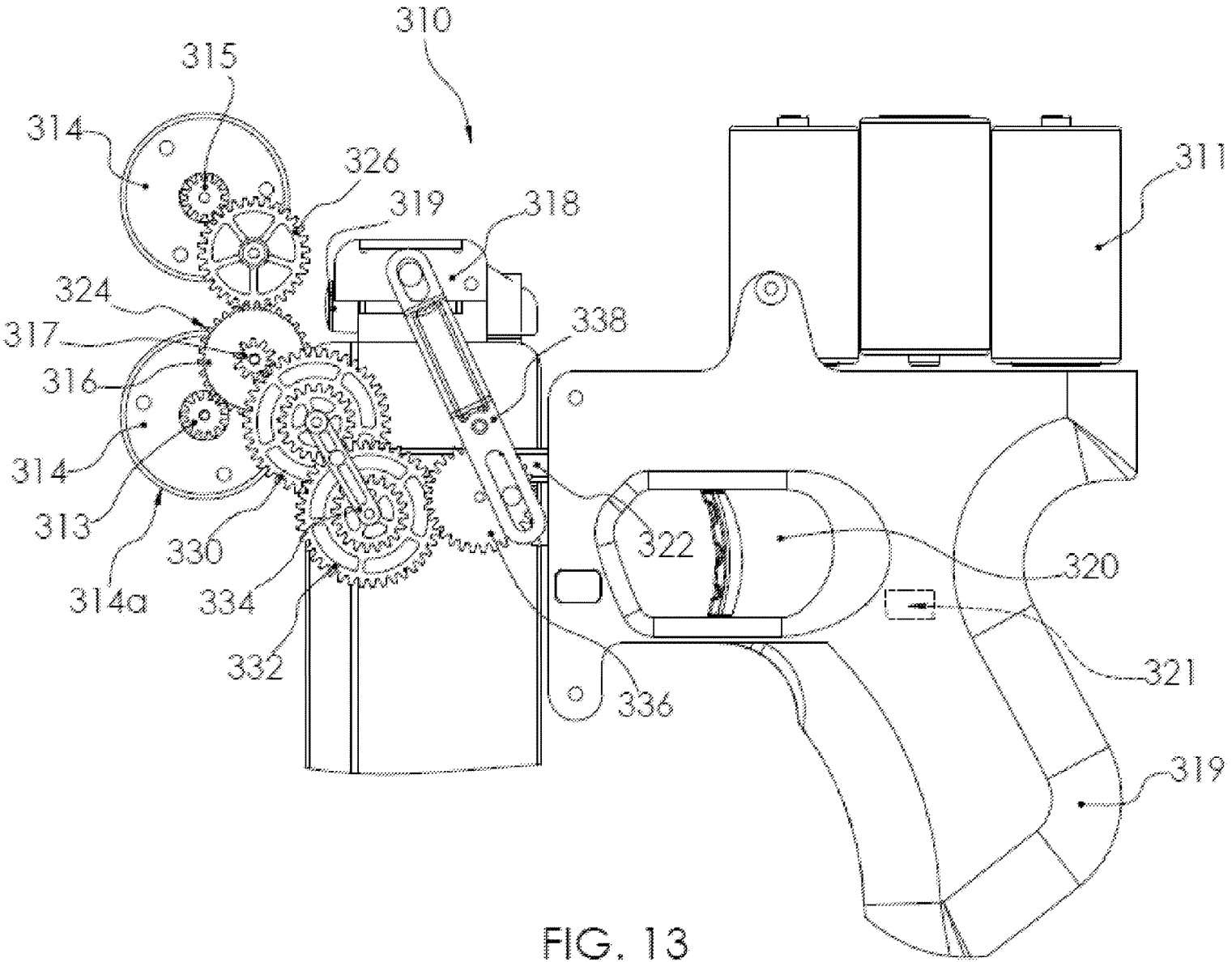
FIG. 13 illustrates disengagement of the swing gear from the crank gear when the trigger is released.

Release of the trigger by the user, as seen in FIG. 13, releases the swing gear 332 back to the first position. A spring coupled to the swing gear 332 easily shifts the swing gear from the second position back to the first position when the trigger linkage 322 is no longer applying a pulling force in the direction of the second position. The pusher/feeding mechanism will continue through inertia to complete the last projectile feeding cycle, but with the release of the swing gear from engagement with the crank gear 336, driving power to the crank gear and the pusher/feeding mechanism has ceased. After the last feeding cycle of the pusher/feeding mechanism is complete, the motor will turn off.

If the trigger is pulled again, before the flywheels are at full operating speed, once again the centrifugal clutch will prevent power from flowing to the pusher/feeding mechanism. This ensures that all projectiles are launched/fired at full power, also making it unnecessary to further include a separate accelerator trigger in the toy projectile launcher apparatus, further eliminating elements to reduce cost and weight.

Figure 14:
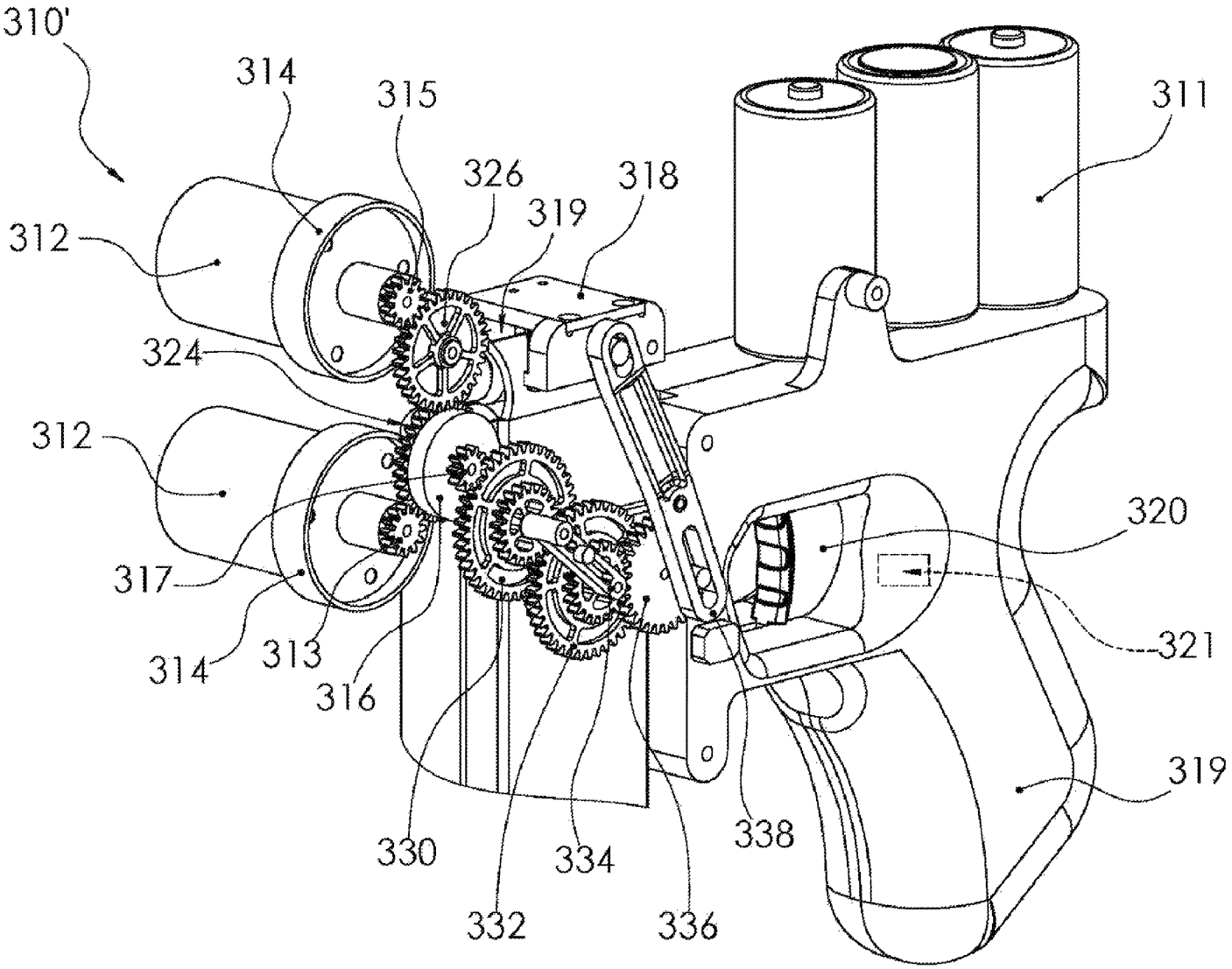
FIG. 14 illustrates a two-motor energizing system with a first motor driving rotation of a first flywheel and the pusher/feeding mechanism a second motor driving rotation of a second flywheel.

A two-motor power system can also be included, as seen in FIG. 14, to drive rotation of the flywheels and the pusher/feeding system. A first motor 312 is in driving rotation with a first direct flywheel 314 and the pusher/feeding mechanism, and a second motor 312 is in driving rotation with a second flywheel 314 and the pusher/feeding mechanism. Each of the first and second motors simultaneously drive each of the first and second flywheels, as well as the pusher gear train through the mechanical connection between idler gears 324 and 326, respectively. A two-motor power system provides the advantage of energizing both the clutch structure and the pusher/feeding mechanism with two motors rather than only one, for quicker achievement of the desired operating speed and activation of the clutch and pusher/feeding mechanism to launch projectiles.

A method for launching projectiles including the steps of providing a motor, providing projectile propelling flywheels linked to the motor, providing a clutch structure engaging the flywheels, the clutch structure including a swing gear operable between a first position a second position, and providing a pusher/feeding mechanism disposed adjacent the flywheels and engaging the motor. Further steps include providing one or more projectiles at the pusher mechanism, providing a trigger assembly including a trigger and trigger linkage assembly linked to the swing gear and engaging clutch structure and the pusher mechanism, pulling the trigger turning on the motor and jump starting rotation of the flywheels, and pulling the swing gear to the second position and into engagement with the pusher mechanism. Further steps include obtaining operating speed at the flywheels and engaging the clutch structure to rotate, and transmitting power from the motor to the pusher mechanism causing back and forth motion of the pusher mechanism advancing projectiles one at a time into the rotating flywheels when the trigger is pulled.

The method for launching projectiles further includes the step of providing a centrifugal clutch as the clutch structure to initiate the pusher/feeding mechanism upon the flywheels obtaining a desired rotational speed for propelling projectiles. The method for launching projectiles further includes the step of providing a micro switch engaging the trigger and the motor activating the motor when the trigger is pulled and shutting off power to the motor when the trigger is released.

The method for launching projectiles further includes the step of providing a trigger linkage assembly mechanically engaging the swing gear to shift from a first position to a second position, and further includes the step of spring biasing the swing gear to the first position. The method for launching projectiles further includes the step of providing a scotch gear coupled to the swing gear through a swing gear linkage securing the swing gear to shift between first and second positions.

From the foregoing, it can be seen that there has been provided features for a launching apparatus and methods employing a motor-driven mechanism for quick start/advanced starting projectile-propelling flywheels and driving a projectile-feeding mechanism in a novel fashion for automatic and sequenced projectile-launching operation with reduced mechanism mass and cost. While particular embodiments of the present inventions have been shown and described, it will be obvious to those skilled in the art that changes and modifications may be made without departing form the inventions in their broader aspects. Therefore, the aim in the appended claims is to cover all such changes and modifications as fall within the true spirit and scope to the inventions. The matter set forth in the foregoing description and accompanying drawings is offered by way of illustration only and not as a limitation. The actual scope to the invention is intended to be defined on the following claims when viewed in their proper perspective based on the prior art.

What is claimed is:

1. A toy projectile launch apparatus, comprising:

a motor;

projectile propelling flywheels linked to the motor;

a clutch structure engaging the flywheels through a flywheel gear train, the clutch structure being operable between first and second positions;

a pusher mechanism disposed adjacent the flywheels and engaging the motor for advancing projectiles into the flywheels one at a time; and a trigger assembly including a trigger and trigger linkage assembly engaging the clutch structure and the pusher mechanism, the trigger assembly jump starting rotation of the flywheels to an operating speed and activating the clutch structure when the flywheels are rotating at the operating speed, shifting the clutch structure into the second position for actuating the pusher mechanism causing back and forth motion of the pusher mechanism advancing projectiles into the rotating flywheels when the trigger is pulled.

2. The toy projectile launch apparatus according to claim 1, wherein the clutch structure includes a centrifugal-clutch initiating the pusher mechanism upon the flywheels having a desired rotational speed for propelling projectiles.

3. The toy projectile launch apparatus according to claim 2, wherein the clutch structure includes a gear structure operable between first and second positions, the gear structure links a pusher/feeding gear train to the centrifugal-clutch which includes a clutch attached gear for transmitting power to the pusher/feeding gear train through the gear structure.

4. The toy projectile launch apparatus according to claim 3, further comprising a cam and follower interaction between a crank gear and a pusher mechanism linkage when the gear structure mechanically engages the crank gear powered by the motor, operating to sequence and activate the pusher mechanism and flywheel propelling mechanism.

5. The toy projectile launch apparatus according to claim 4, further comprising a micro-switch engaging the trigger and the motor for activating the motor when the trigger is depressed and shutting off power to the motor when the trigger is released.

6. The toy projectile launch apparatus according to claim 5, wherein the trigger linkage assembly mechanically engages the gear structure and shifts the gear structure from a first position to the second position when the trigger is pulled.

7. The toy projectile launch apparatus according to claim 6, wherein the gear structure is spring biased to the first position.

8. The toy projectile launch apparatus according to claim 7, wherein the pusher/feeding gear train employs a scotch gear and gear structure linkage coupling the scotch gear to the gear structure allowing the gear structure to shift between first and second positions.

9. The toy projectile launch apparatus according to claim 1, wherein the clutch structure further comprises a torsion booster spring engaging the motor through a spring winding gear train and engaging the flywheels through the flywheel gear train, the torsion booster spring is primed to a charged position when the motor is turned on and the trigger assembly jump starting the flywheels through the torsion booster spring.

10. The toy projectile launch apparatus according to claim 8, further comprising a two-motor power system, with a first motor coupled to a first flywheel and a second motor coupled to a second flywheel, with first and second motors driving rotation of first and second flywheels, respectively, and the pusher/feeding mechanism.

11. The toy projectile launch apparatus according to claim 1, wherein the clutch comprises a manually operable activation trigger button.

12. A method for launching projectiles, comprising the steps of:

holding projectiles in a magazine for receiving;

providing a carriage structure with a launch channel supported with the magazine;

injecting projectiles from the magazine into the launch channel at a feeding mechanism in communication with the magazine;

coupling a propelling mechanism with the carriage structure by including flywheels in communication with the launch channel for propelling projectiles from the magazine;

feeding with a launching motor powered through a transmission gear assembly to sequence and activate the feeding mechanism and the propelling mechanism; and activating the feeding mechanism with a clutch in communication the motor transmission gear assembly.

13. The method for launching projectiles according to claim 12, operating the clutch in communication transmission gear assembly to sequence and activate the feeding mechanism and the propelling mechanism through a spring biased cam follower from the transmission gear assembly, the spring biased cam follower extending and retracting between a first extended and a second retracted position to engage and shuttle additional projectiles from the magazine.

14. A method for launching projectiles, comprising the steps of:

providing a motor;

providing projectile propelling flywheels linked to the motor;

providing a clutch structure engaging the flywheels, the clutch structure operable between a first position a second position;

providing a pusher mechanism disposed adjacent the flywheels and engaging the motor;

providing one or more projectiles at the pusher mechanism;

providing a trigger assembly including a trigger and trigger linkage assembly engaging clutch structure and the pusher mechanism;

pulling the trigger turning the motor on jump starting rotation of the flywheels and moving the clutch structure to the second position and into engagement with the pusher mechanism;

obtaining operating speed at the flywheels and engaging the clutch structure to rotate; and transmitting power from the motor to the pusher mechanism causing back and forth motion of the pusher mechanism advancing projectiles one at a time into the rotating flywheels when the trigger is pulled.

15. The method for launching projectiles according to claim 14, further comprising the step of providing a gear structure as the clutch structure to initiate the pusher mechanism upon the flywheels obtaining a desired rotational speed for propelling projectiles.

16. The method for launching projectiles according to claim 15, further comprising the step of providing a micro switch engaging the trigger and the motor activating the motor when the trigger is pulled and shutting off power to the motor when the trigger is released.

17. The method for launching projectiles according to claim 16, further comprising the step of providing a trigger linkage assembly mechanically engaging the clutch structure to shift from a first position to a second position.

18. The method for launching projectiles according to claim 17, further comprising the step of spring biasing the clutch structure to the first position.

19. The method for launching projectiles according to claim 18, further comprising the step of providing a scotch gear coupled to the clutch structure through a linkage to shift between first and second positions.

20. The method for launching projectiles according to claim 14, wherein the clutch comprises a manually operable activation trigger button.

* * * * *